US007360866B2

(12) United States Patent
Kitagawa et al.

(10) Patent No.: US 7,360,866 B2
(45) Date of Patent: Apr. 22, 2008

(54) PRINTER AND HEAD UNIT FABRICATING METHOD

(75) Inventors: Osamu Kitagawa, Kyoto (JP); Masayuki Murai, Kyoto (JP); Seiji Mochizuki, Nagano (JP); Masahiro Nakamura, Nagano (JP)

(73) Assignees: Dainippon Screen Mfg. Co., Ltd., Kyoto (JP); Seiko Epson Corporation, Nagano (JP)

( * ) Notice: Subject to any disclaimer, the term of this patent is extended or adjusted under 35 U.S.C. 154(b) by 356 days.

(21) Appl. No.: 11/247,144

(22) Filed: Oct. 12, 2005

(65) Prior Publication Data

US 2006/0077226 A1 Apr. 13, 2006

(30) Foreign Application Priority Data

Oct. 13, 2004 (JP) ..... P2004-298880
Aug. 17, 2005 (JP) ..... P2005-236720

(51) Int. Cl.
*B41J 2/145* (2006.01)
*B41J 2/15* (2006.01)

(52) U.S. Cl. ..... 347/40; 347/49

(58) Field of Classification Search ..... 347/40, 347/42, 49

See application file for complete search history.

(56) References Cited

U.S. PATENT DOCUMENTS 5,984,447 A * 11/1999 Ohashi ..... 347/9
6,412,903 B1 * 7/2002 Lee et al. ..... 347/19

FOREIGN PATENT DOCUMENTS

| | | |
|---|---|---|
| EP | 1 225 472 A2 | 7/2002 |
| EP | 1 375 146 A1 | 1/2004 |
| JP | 06-286140 | 10/1994 |
| JP | 10-081015 | 3/1998 |
| JP | 10-337862 | 12/1998 |
| JP | 2002-113849 | 4/2002 |
| JP | 2003-159786 | 6/2003 |
| JP | 2003-305832 | 10/2003 |

OTHER PUBLICATIONS

European Search Report issued in corresponding European Patent Application No. 05 02 2063, dated Feb. 2, 2007.

* cited by examiner

*Primary Examiner*—Thinh Nguyen
(74) *Attorney, Agent, or Firm*—McDermott Will & Emery LLP

(57) ABSTRACT

In a head unit of a printer, a head (5A) has outlet rows (611, 612, 621 and 622) arranged along a first tilt direction and a gap between outlets in the outlet rows (611 and 612) is interpolated with a outlet in the outlet rows (621 and 622) by a slight tilt. A head (5C) adjacent to the head (5A) is tilted in a second tilt direction opposite to the first tilt direction. In the printer, a plurality of dots are formed, being aligned on a piece of printing paper in the first tilt direction by performing an ejection control simultaneously for all outlets in each outlet row of the head (5A) and subsequently a plurality of dots are formed, being aligned on the piece of printing paper in the second tilt direction by performing an ejection control simultaneously for all the outlets in each outlet row of the head (5C), to make both rows of dots continuous. Through this operation, the printer can easily perform high-resolution printing without such a complicate ejection control as to control ejection of ink for each outlet (7).

14 Claims, 13 Drawing Sheets

PRINTER AND HEAD UNIT FABRICATING METHOD

BACKGROUND OF THE INVENTION

1. Field of the Invention

The present invention relates to an inkjet printer and a method of fabricating a head unit for ejecting droplets of ink in an inkjet manner.

2. Description of the Background Art

In an inkjet printer, a head having outlet groups each of which ejects fine droplets of ink is used and by tilting the arrangement direction of the outlet groups in the head toward a direction orthogonal to a movement direction of the head relative to printing paper (i.e., a scan direction of the head), it is possible to change the resolution of an image to be written. Japanese Patent Application Laid Open Gazette No. 6-286140 (Document 1), Japanese Patent Application Laid Open Gazette No. 2003-305832 (Document 2) and Japanese Patent Application Laid Open Gazette No. 2002-113849 (Document 3), for example, disclose a technique in which a row of outlets which are aligned is tilted toward a direction orthogonal to a scan direction of a head and an ejection control of ink is performed for each of the outlets, to perform image writing at a high resolution, and Japanese Patent Application Laid Open Gazette No. 10-81015 (Document 4) discloses a technique in which a plurality of outlet rows each of which is tilted are arranged in a scan direction of a head, to perform image writing at a higher resolution. Japanese Patent Application Laid Open Gazette No. 2003-159786 (Document 5) discloses a technique in which a plurality of heads are arranged in a direction orthogonal to a scan direction of the heads with an arrangement direction of outlet groups tilted, to perform image writing in a wider range of printing paper with one scan.

On the other hand, another type of inkjet printer is well known, in which a plurality of heads are provided in a head unit and four outlet rows each having outlets disposed in a direction orthogonal to a scan direction (for example, at a pitch corresponding to 360 dpi (dot per inch)) are arranged along a scan direction in each head. In this printer, inks of four colors, i.e., K (black), C (cyan), M (magenta) and Y (yellow), are assigned to the four outlet rows in each head and a plurality of heads are disposed in two-row staggered arrangement along a direction orthogonal to the scan direction, to perform color printing at a resolution of 360 dpi on entire printing paper with one scan. In a case of color printing at a resolution of 720 dpi, two more rows of heads, like the two rows of heads for 360 dpi, are arranged in a direction orthogonal to the scan direction with half pitch shifted.

Further, Japanese Patent Application Laid Open Gazette No. 10-337862 discloses a technique for easily attaching a plurality of heads to a printer, in which a plurality of heads are fixed, being positioned, onto a holder and further fixed to a head unit body through the holder.

The techniques discloses in Documents 1 to 5, which are based on the premise that an ejection timing of ink is controlled for each outlet, need a complicate ejection control. In the color printer having the above head unit, for increasing the resolution, it is necessary to perform a high-level position adjustment for a plurality of heads in two respective directions corresponding to the scan direction and the direction orthogonal thereto and therefore fabrication of the head unit is not easy.

SUMMARY OF THE INVENTION

The present invention is intended for an inkjet printer and it is an object to provide a printer which is capable of performing printing at a predetermined resolution without a complicate ejection control.

According to the present invention, the printer comprises a head unit for ejecting droplets of ink onto printing media, a moving mechanism for moving the head unit relatively to the printing media toward a predetermined scan direction along the printing media, and an ejection control part for controlling ejection of ink from the head unit, and in the printer, the head unit comprises a first ejection module including a first outlet group, and a second ejection module including a second outlet group disposed at a predetermined distance away from the first outlet group in the scan direction, adjacently to the first outlet group in a width direction orthogonal to the scan direction, the first outlet group includes at least one first outlet row in which outlets are arranged in a first tilt direction which tilts from the width direction by a minute angle in a plane parallel to the printing media, the second outlet group includes at least one second outlet row in which outlets are arranged in a second tilt direction which tilts from the width direction to an opposite side of the first tilt direction by the minute angle in a plane parallel to the printing media, outlets in each of the at least one first outlet row and outlets in any of the at least one second outlet row are continuously disposed at a regular pitch in the width direction, and with a control by the ejection control part, a writing is performed on a first line segment which is directed toward the first tilt direction on the printing media through a first ejection control performed simultaneously for all outlets in each first outlet row and after the head unit is moved relatively to the printing media by the predetermined distance from a position of the first ejection control, a writing is performed on a second line segment which extends in the second tilt direction continuously from the first line segment through a second ejection control performed simultaneously for all outlets in each second outlet row.

By the present invention, it is possible to perform printing at a finely-adjusted resolution, without a complicate ejection control.

According to one preferred embodiment of the present invention, the first ejection module includes another first outlet group disposed away from the first outlet group in the scan direction in the same manner as the first outlet group, which interpolates dots written by the first outlet group in the width direction and the second ejection module includes another second outlet group disposed away from the second outlet group in the scan direction in the same manner as the second outlet group, which interpolates dots written by the second outlet group in the width direction, and it is thereby possible to easily perform high-resolution printing by using a low-resolution head, without a high-level position adjustment.

According to another preferred embodiment of the present invention, the first outlet group ejects ink of one color and the first ejection module includes a first outlet group for ejecting ink of another color, which is disposed in the same manner as the first outlet group for ejecting ink of the one color, the second outlet group ejects ink of the one color and the second ejection module includes a second outlet group for ejecting ink of the another color, which is disposed in the same manner as the second outlet group for ejecting ink of the one color, and outlet group for ejecting ink of the one color and outlet group for ejecting ink of the another color are arranged in the same order in the scan direction in each of the first ejection module and the second ejection module. It is thereby possible to prevent variation in mixed color on printing media after printing, which is caused by the order of the outlet group for ejecting ink of one color and the outlet group for ejecting ink of another color in the first ejection module and the second ejection module in the scan direction.

The present invention is also intended for a head unit fabricating method for fabricating a head unit which ejects droplets of ink in an inkjet manner, and it is another object to easily fabricate a head unit.

According to an aspect of the present invention, the head unit fabricating method comprises the steps of a) attaching a plurality of first ejection modules each comprising a first outlet group disposed in a predetermined arrangement direction along a long-length first holder with the arrangement direction tilted from a longitudinal direction of the first holder by a minute angle, b) attaching a plurality of second ejection modules each comprising a second outlet group disposed in a predetermined arrangement direction along a long-length second holder with the arrangement direction tilted from a longitudinal direction of the second holder to the opposite side of the case of the first holder by the minute angle, and c) arranging the first holder and the second holder in a direction orthogonal to longitudinal directions thereof, with the longitudinal directions thereof made uniform, and continuously arranging a plurality of first outlet groups and a plurality of second outlet groups alternately group by group in the longitudinal directions, and by this method, it is possible to easily fabricate a head unit.

According to another aspect of the present invention, the head unit fabricating method comprises the steps of attaching a plurality of ejection modules each comprising an outlet group disposed in a predetermined arrangement direction onto a first holder and a second holder, with the arrangement direction made parallel to a longitudinal direction of long-length holders, and arranging the first holder and the second holder in a direction orthogonal to a predetermined reference direction, to be tilted from the reference direction to opposite sides by a minute angle, and continuously arranging a plurality of first outlet groups in ejection modules attached on the first holder and a plurality of second outlet groups in ejection modules attached on the second holder alternately group by group in the reference direction, and by this method, it is possible to easily fabricate a head unit.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
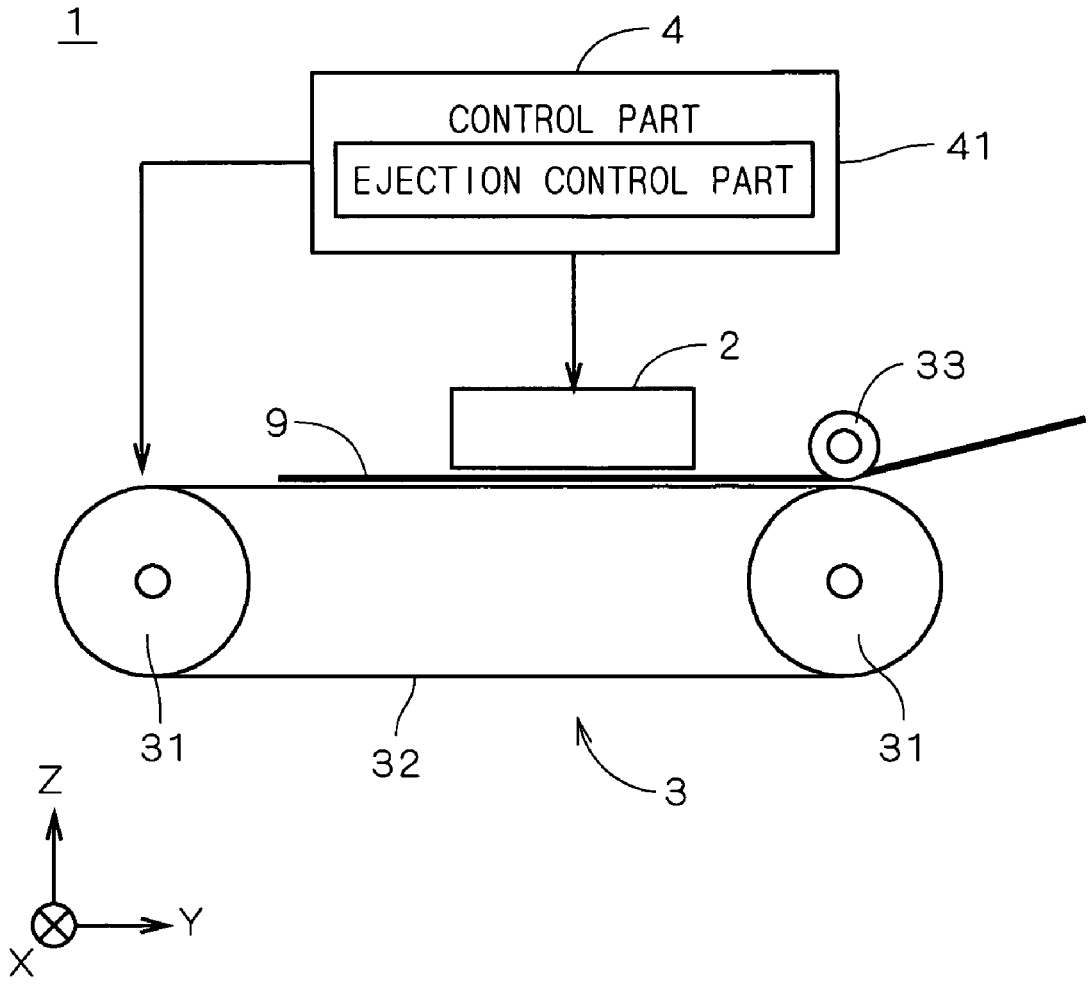
FIG. 1 is a view showing a construction of a printer.

FIG. 1 is a view showing a construction of an inkjet printer 1 in accordance with one preferred embodiment of the present invention. The printer 1 comprises a head unit 2 for ejecting fine droplets of ink onto printing paper 9, a feeder 3 for moving the printing paper 9 toward the Y direction of FIG. 1 under the head unit 2 and a control part 4 which has an ejection control part 41 for controlling ejection of ink from the head unit 2 and performs a general control of the printer 1.

The feeder 3 has two belt rollers 31 connected to a not-shown motor and a belt 32 hanging between the two belt rollers 31. The printing paper 9 is guided onto the belt 32 through a roller 33 provided above the belt roller 31 on the (+Y) side and held there and moved toward the (−Y) side, passing under the head unit 2 together with the belt 32. With the above operation of the feeder 3, the head unit 2 moves (scans) in the (+Y) direction along the printing paper 9, relatively to the printing paper 9. The feeder 3 may have a construction where a suction part is provided at a position opposite to the head unit 2 inside the loop-like belt 32 and very small suction holes are formed on the belt 32, to hold the printing paper 9 on the belt 32 by suction.

Figure 2:
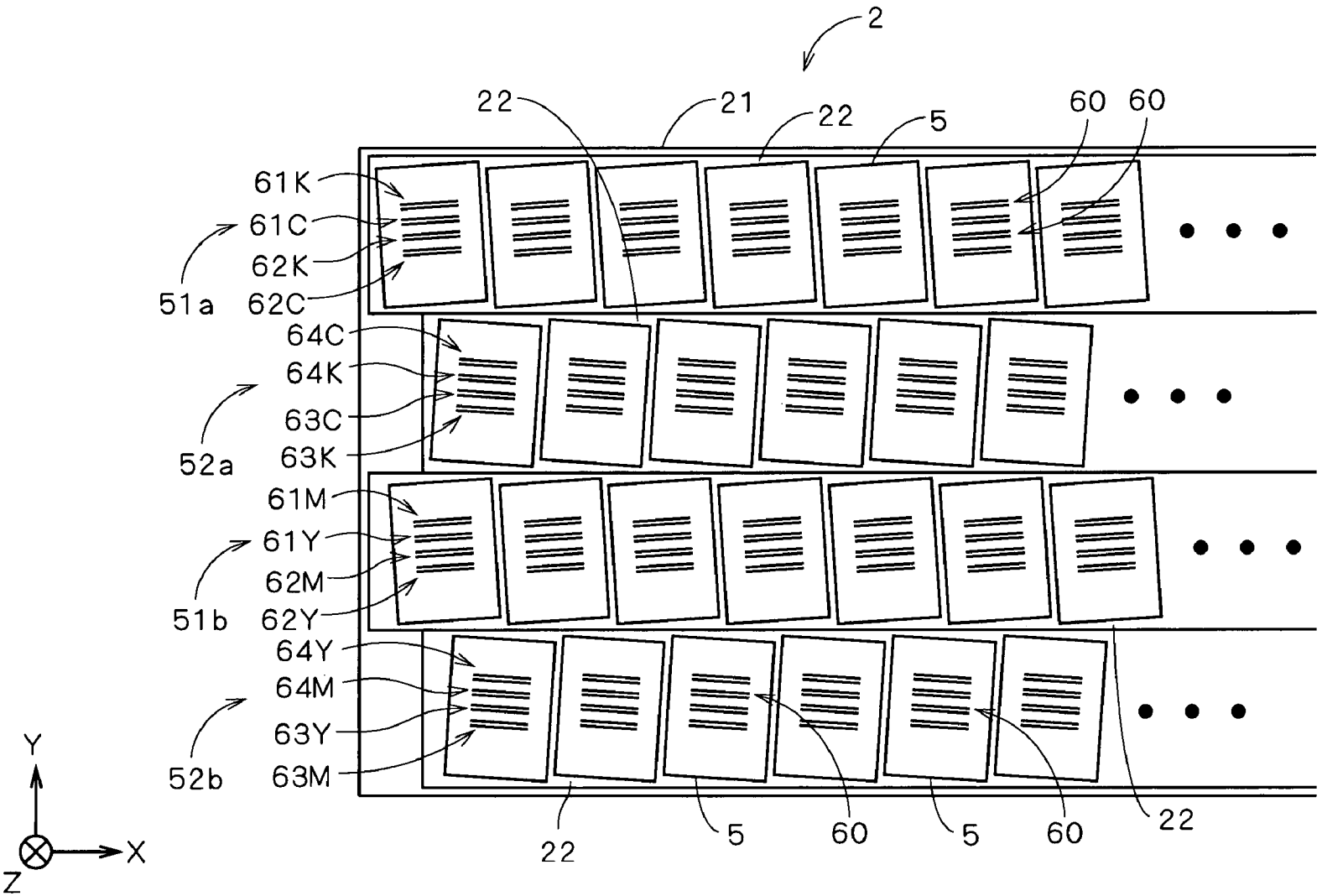
FIG. 2 is a bottom plan view showing a construction of a head unit.

FIG. 2 is a bottom plan view showing a construction of the head unit 2, which vertically shows a scan direction of the head unit 2 with respect to the printing paper 9 (i.e., the Y direction). The head unit 2 shown in FIG. 2 has four long-length holders 22 each of which is almost as long as the width of the printing paper 9 in a direction orthogonal to the scan direction (the X direction of FIG. 2 and hereinafter referred to as "width direction" since the direction corresponds to the width of the printing paper 9), and the four holders 22 are fixed onto a head unit body 21, being arranged in the scan direction. To each holder 22, a plurality of heads are attached, being arranged in the width direction, and the heads 5 attached to one holder 22 form one head row which is so arranged in the width direction as to be almost as long as the width of the printing paper 9. There may be a construction where a plurality of relatively short holders 22 are arranged in the width direction and one head row consists of heads 5 attached to the holders 22 arranged in the width direction.

Each head 5 has a plurality of outlet groups 60 (one outlet group 60 is indicated by a double line in FIG. 2), and each outlet group 60 is a set of outlets which are arranged. Each of a plurality of heads 5 included in a head row 51*a* on the (+Y) side has an outlet group 61K for ejecting ink of K (black), an outlet group 61C for ejecting ink of C (cyan), an outlet group 62K for ejecting ink of K and an outlet group 62C for ejecting ink of C which are arranged in this order from the (+Y) side (toward the (−Y) side). Each of heads 5 included in a head row 52*a* adjacent to the head row 51*a* on the (−Y) side has an outlet group 64C for ejecting ink of C, an outlet group 64K for ejecting ink of K, an outlet group 63C for ejecting ink of C and an outlet group 63K for ejecting ink of K which are arranged in this order from the (+Y) side.

Each of a plurality of heads 5 included in a head row 51*b* adjacent to the head row 52*a* on the (−Y) side has an outlet group 61M for ejecting ink of M (magenta), an outlet group 61Y for ejecting ink of Y (yellow), an outlet group 62M for ejecting ink of M and an outlet group 62Y for ejecting ink of Y which are arranged in this order from the (+Y) side, and each of heads 5 included in a head row 52*b* on the (−Y) side has an outlet group 64Y for ejecting ink of Y, an outlet group 64M for ejecting ink of M, an outlet group 63Y for ejecting ink of Y and an outlet group 63M for ejecting ink of M which are arranged in this order from the (+Y) side.

The heads 5 included in the head rows 51*a* and 51*b* (hereinafter, any one of these head rows is referred to as "head row 51") are fixed to be tilted by a predetermined minute (slight) rotation angle with respect to an axis parallel to the Z axis, and the outlet groups 60 in each head 5 are also tilted in a like manner. The heads 5 included in the head rows 52*a* and 52*b* (hereinafter, any one of these head rows is referred to as "head row 52") are fixed to be tilted by same minute rotation angle with respect to an axis parallel to the Z axis toward the opposite side of the heads 5 in the head row 51, and the outlet groups 60 in each head 5 are also tilted in a like manner.

Thus, each head 5 included in the head row 51 has two outlet groups 60 for ejecting ink of one color and two outlet groups 60 for ejecting ink of another color, which are arranged in the same manner as the outlet groups 60 for ink of one color, and each head 5 included in the head row 52 corresponding to the head row 51 has two outlet groups 60 for ejecting ink of one color and two outlet groups 60 for ejecting ink of another color, which are arranged in the same manner as the outlet groups 60 for ink of one color. In each head 5, the outlet groups 60 for ejecting ink of one color and the outlet groups 60 for ejecting ink of another color are alternately arranged in the scan direction.

Figure 3:
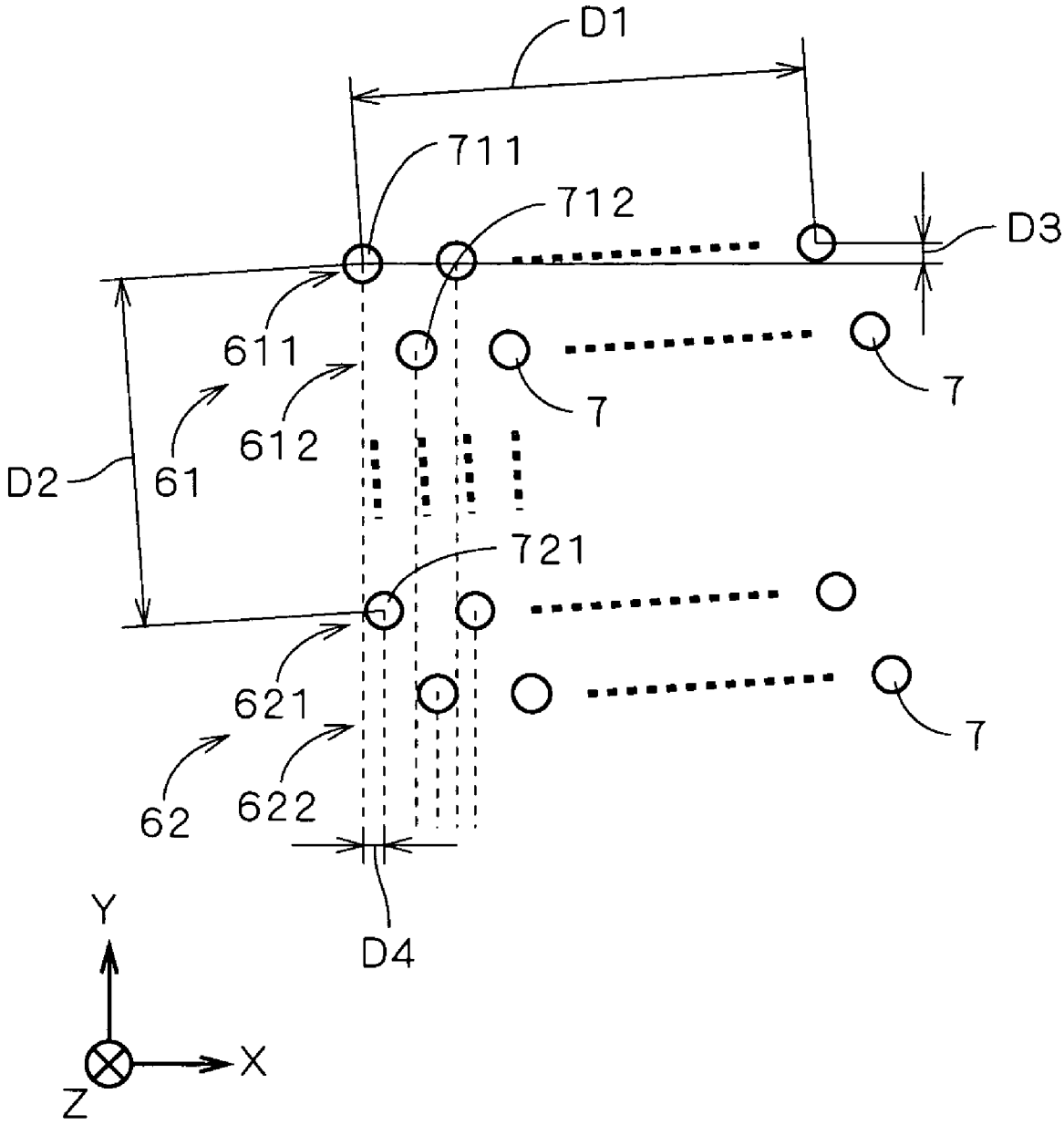
FIG. 3 is a view showing outlet groups in one head.

FIG. 3 is a view showing the outlet groups in one head 5, and FIG. 3 shows only the outlet groups 61 and 62 for ejecting ink of the same color in one head 5 included in the head row 51. Though the following discussion will be made on only the outlet groups for ejecting ink of one of the four colors, i.e., CMYK, the outlet groups for ejecting ink of other colors have the same construction and arrangement.

The outlet group 61 which is an antecedent one in a traveling direction ((+Y) direction) of the head unit 2 relative to the printing paper 9 (the outlet group is hereinafter referred to as "an antecedent outlet group") has two outlet rows 611 and 612 in each of which a plurality of outlets 7 are arranged. In each of the outlet rows 611 and 612, a plurality of outlets 7 are arranged at a regular pitch toward a direction (hereinafter, referred to as "the first tilt direction") tilted from the width direction (X direction) by a predetermined minute angle θ in a plane parallel to the printing paper 9 (a plane parallel to the XY plane). In the antecedent outlet group 61, a plurality of outlets 7 are disposed in a staggered arrangement so that one of the outlets 7 in the outlet row 612 should be positioned between two adjacent outlets 7 in the outlet row 611 in the width direction. An outlet group 62 which follows the antecedent outlet group 61, being away therefrom in the scan direction (on the (−Y) side), (the outlet group is hereinafter referred to as "a following outlet group"), like the antecedent outlet group 61, also has a plurality of outlets 7 which are disposed in two-row staggered arrangement (i.e., in two outlet rows 621 and 622) along the first tilt direction.

With respect to the width direction, in the outlet groups 61 and 62 of FIG. 3, for example, the first tilt direction (in other words, a rotation angle of the head 5) is determined so that one outlet 721 in the following outlet group 62 should be positioned between one outlet 711 in the outlet row 611 and one outlet 712 in the outlet row 612 which is adjacent to the outlet 711 in the width direction. In other words, the minute angle θ of the first tilt direction with respect to the width direction is determined to be an angle at which one of the outlets 7 in the following outlet group 62 interpolates a gap between the two adjacent outlets 7 in the antecedent outlet group 61 in the width direction. In the head 5 of FIG. 3, a plurality of outlets 7 in the outlet groups 61 and 62 are thereby densely continuous.

In actuality, a head having outlet rows in which a plurality of outlets 7 are arranged at a pitch corresponding to 180 dpi without being tilted (in other words, in a posture where the outlet rows should be parallel to the width direction) is used, and in this state, the outlets 7 are disposed in two-row staggered arrangement in each outlet group 60. In the printer 1, a plurality of heads 5 are arranged, being tilted, to form the head unit 2. Each of the heads 5 which are arranged in the head unit 2 is tilted so that a distance D1 between the outlets 7 on both ends of each outlet row in the first tilt direction should be 25.3 mm, a distance D2 between the outlet groups 61 and 62 (between the outlet rows 611 and 621 in FIG. 3) in a direction orthogonal to the first tilt direction should be 20 mm and a distance D3 between the outlets 7 on both ends in each outlet row in the scan direction should be 44 μm. A plurality of outlets 7 in the outlet groups 61 and 62 in the head 5 are thereby continuous at a pitch corresponding to a resolution close to 720 dpi (exactly, slightly higher than 720 dpi) in the width direction. In this case, a distance D4 between the outlet 711 in the outlet row 611 and the outlet 721 in the outlet row 621 in the width direction is 35 μm.

The outlet groups 60 of each of the heads 5 included in the head rows 52*a* and 52*b* shown in FIG. 2 is different from the outlet groups 61 and 62 shown in FIG. 3 only in that each of the outlet rows is arranged in a second tilt direction tilted from the width direction toward the opposite side of the first tilt direction by the same angle θ as that of the first tilt direction.

Figure 4:
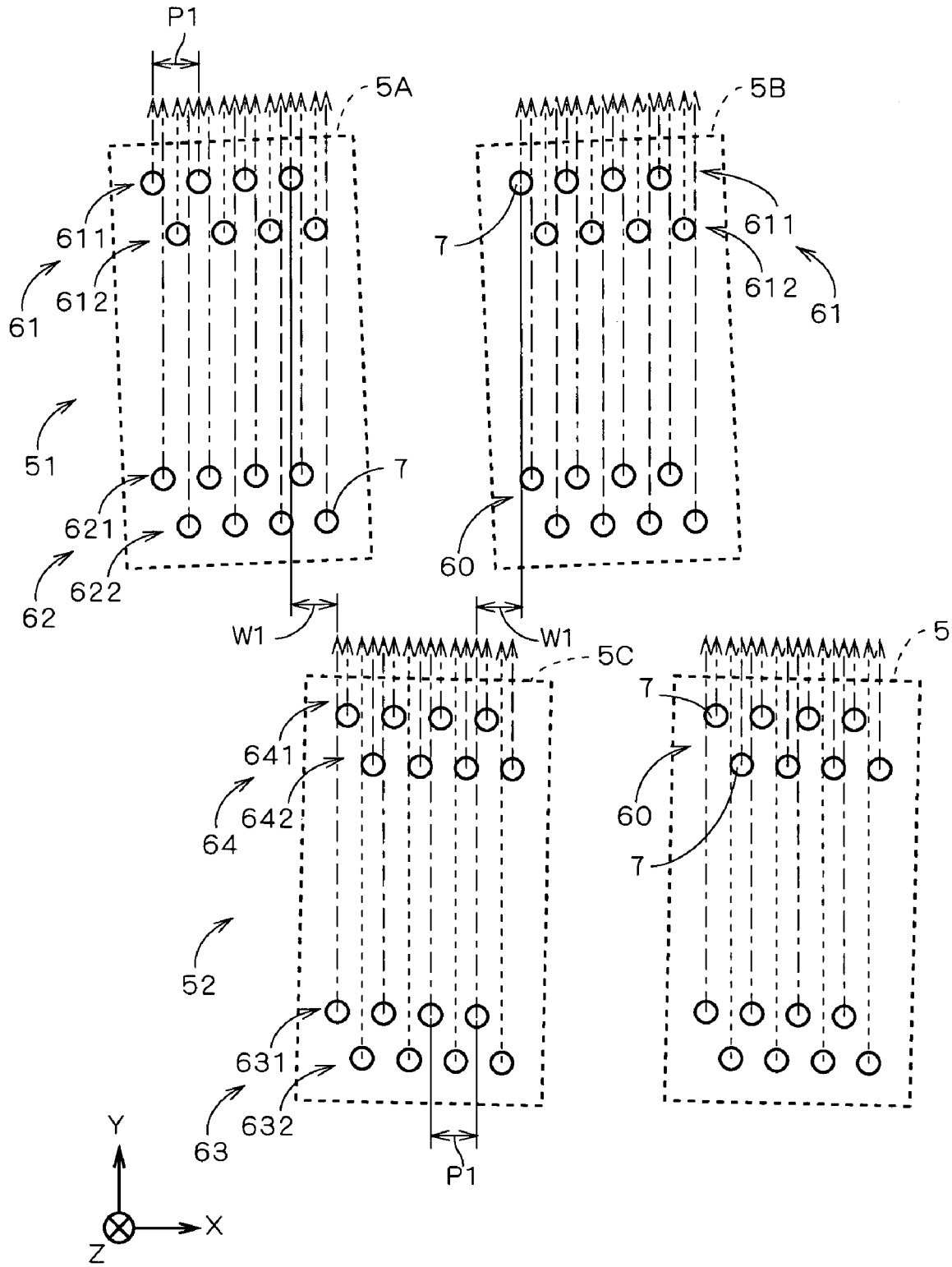
FIG. 4 is a view showing outlet groups in a plurality of heads.

FIG. 4 is a view showing outlet groups 60 in a plurality of heads 5. In FIG. 4, for convenience of illustration, eight outlets 7 are disposed in two-row staggered arrangement in one outlet group 60. Though discussion will be made below on the arrangement of the outlets 7 of FIG. 4, as discussed above, a lot of outlets 7 are actually arranged in each head 5.

Between two heads 5 in the head row 51 (in FIG. 4, for example, a head 5A on the left side and a head 5B on the right side), at a position away therefrom by a predetermined distance in the scan direction (Y direction), one head 5 in the head row 52 (for example, a head 5C in FIG. 4) is disposed. As discussed above, an antecedent outlet group 64 in each head 5 of the head row 52 has two outlet rows 641 and 642 in which the outlets 7 are arranged in the second tilt direction tilted from the width direction toward the opposite side of the first tilt direction by the same angle θ, and a following outlet group 63 away from the antecedent outlet group 64 in the scan direction also has two outlet rows 631 an 632 tilted in the same manner as the antecedent outlet group 64.

With respect to the width direction, in the outlet row 611 in each head 5 of the head row 51 and the outlet row 631 in each head 5 of the head row 52, the outlets 7 are arranged at the same pitch P1, and a distance between the outlet 7 on one end of the outlet row 611 and the outlet 7 in the outlet row 631, which is adjacent to the above outlet 7 in the width direction, (the distance represented by the reference sign W1 in FIG. 4) is the same as the pitch P1 in the outlet rows 611 and 631. In other words, the heads 5 in the head rows 51 and 52 are arranged so that a plurality of outlets 7 in the outlet rows 611 and a plurality of outlets 7 in the outlet rows 631 should be continuous at the regular pitch P1 in the width direction.

Similarly in the outlet rows 612 and 632, the outlet rows 621 and 641 and the outlet rows 622 and 642, the outlets 7 are continuous at the regular pitch P1 in the width direction. Thus, in the head unit 2, the outlets 7 in each of a plurality of outlet rows of the head 5 included in the head row 51 and the outlets 7 in any one of a plurality of outlet rows of the head 5 included in the head row 52 are continuously disposed at the regular pitch P1 in the width direction. Therefore, in the whole of the head unit 2, for one color, the outlets 7 are continuous at a pitch corresponding to a predetermined resolution (slightly higher than 720 dpi) in the width direction.

Considering the arrangement of the outlets 7 with the outlet group 60 as a unit, from the above correspondence of the outlet rows, it can be thought that the antecedent outlet groups 61 in the heads 5 of the head row 51 and the following outlet groups 63 in the heads 5 of the head row 52 are in a correspondence with each other and the following outlet groups 62 in the heads 5 of the head row 51 and the antecedent outlet groups 64 in the heads 5 of the head row 52 are in a correspondence with each other, and in the scan direction, the following outlet groups 62 and the corresponding antecedent outlet groups 64 are positioned between the antecedent outlet groups 61 and the corresponding following outlet groups 63 which are away from each other by a predetermined distance.

Next, discussion will be made on a printing operation of the printer 1 on the printing paper 9. In the printer 1, the ejection control part 41 controls ejection of ink from the head unit 2 in synchronization with the feed speed of the feeder 3 for the printing paper 9. In detail, first, a feed operation for the printing paper 9 is started and in the ejection control part 41 ON/OFF control of ejection of ink is performed simultaneously for all outlets 7 in the outlet rows 611 of the antecedent outlet groups 61 of FIG. 4 on the basis of writing data prepared in advance, to form dots on the printing paper 9 (in other words, a writing operation is performed).

Figure 5:
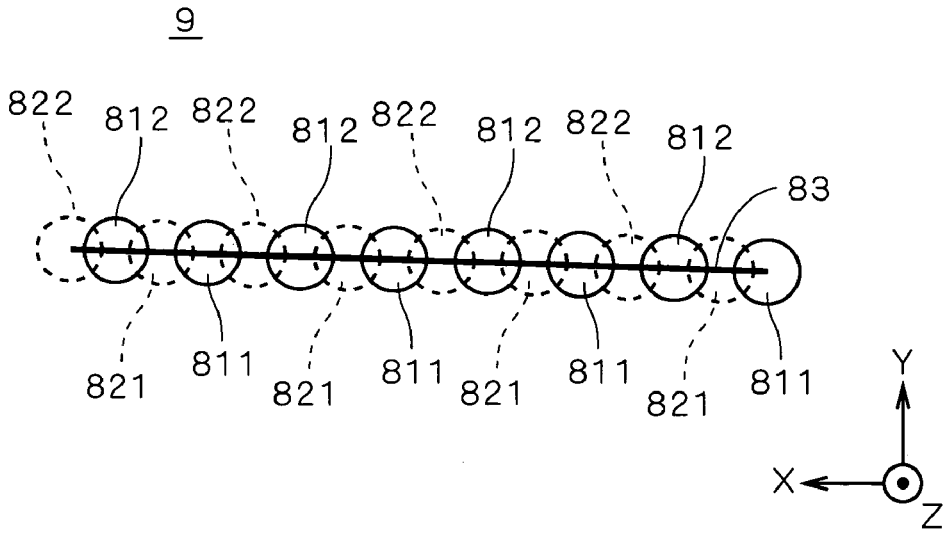
FIG. 5 is a view showing dots written on printing paper.

FIG. 5 is a view showing dots formed on the printing paper 9 by one head 5 of the head row 51, where it is assumed that even when ejection of ink is not performed in accordance with the writing data, the dots are virtually formed. As indicated by solid circles 811 in FIG. 5, dots are simultaneously written on the printing paper 9 at a regular pitch in the width direction (X direction) by the outlets 7 of the outlet row 611.

Immediately after the dots 811 are formed, the outlet rows 612 positioned on the (−Y) side of the outlet rows 611 reaches above the dots 811 on the printing paper 9 and an ejection control is performed for all the outlets 7 in the outlet rows 612 at the same time. Then, a plurality of dots 812 are so written as to each interpolate a gap between two adjacent dots 811 in FIG. 5. A plurality of dots 811 and 812 are formed on a virtual line segment 83 along the first tilt direction by the two outlet rows 611 and 612 in each antecedent outlet group 61.

When the head unit 2 further scans the printing paper 9 and the following outlet groups 62 reach above the dots 811 and 812 on the printing paper 9, the ejection control in the outlet rows 621 on the (+Y) side and that in the outlet rows 622 on the (−Y) side are sequentially performed for all the outlets 7 at the same time in each outlet rows, and a plurality of dots (dots indicated by broken lines in FIG. 5) 821 and 822 are formed by the outlet rows 621 and 622, respectively. At this time, each of the dots 821 and 822 is formed between two dots 811 and 812 which are adjacent to each other on the line segment 83 (except the dot 822 on the (+X) side). In other words, the dots 811 and 812 written by the antecedent outlet groups 61 are interpolated by the dots 821 and 822 written by the following outlet groups 62 in the width direction. Thus, by the control of the ejection control part 41, the ejection control for all the outlets 7 in each outlet rows 611, 612, 621 and 622 is made at the same time in the heads included in the head row 51, to perform writing on the line segment 83 directed toward the first tilt direction on the printing paper 9.

After the head unit 2 further moves relatively to the printing paper 9, when the antecedent outlet groups 64 in the head row 52 reach the same positions as the dots 811, 812, 821 and 822 on the printing paper 9 in the scan direction, the ejection control is performed for all the outlets 7 at the same time in each outlet rows 641 and 642 to write a plurality of dots on a line segment extending in the second tilt direction, which is continuous from the line segment 83. Subsequently, in the following outlet groups 63, similarly, the ejection control is performed simultaneously for all the outlets 7 in each outlet rows 631 and 632 and the dots written by the antecedent outlet groups 64 are thereby interpolated by the dots written by the following outlet groups 63 in the width direction.

Figure 6:
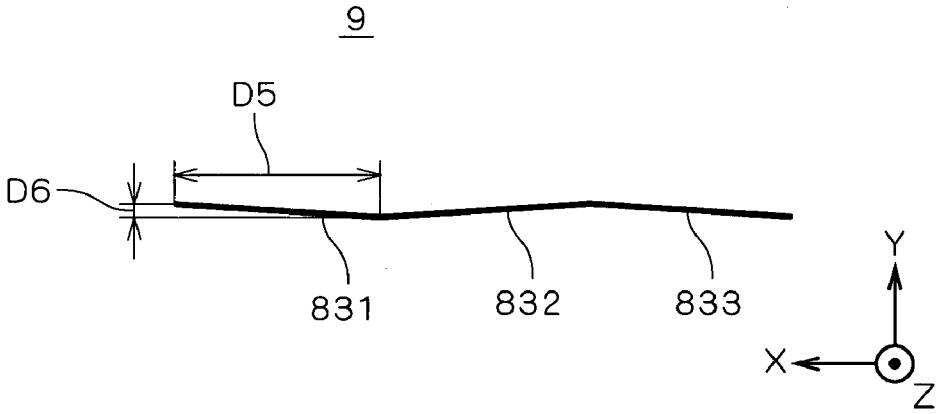
FIG. 6 is a view showing an arrangement of dots written on the printing paper.

FIG. 6 is a view showing an arrangement of dots written on the printing paper 9, and in FIG. 6, the line segments 831, 832 and 833 indicate part of the arrangement of dots. As shown in FIG. 6, in the printer 1, the line segments 831 and 833 tilted along the first tilt direction and the line segments 832 tilted along the second tilt direction are alternately connected to one another on the printing paper 9, and a plurality of line segments (in FIG. 6, only some line segments 831 to 833 are shown) are continuous in a winding manner entirely in the width direction (X direction) of the printing paper 9.

In the case of arrangement of the outlets 7 discussed referring to FIG. 3, a length D5 of each line segment in the width direction in FIG. 6 is 25.4 mm and a length D6 thereof in the scan direction (Y direction) is 44 μm (in this figure, the length D6 in the scan direction is exaggeratedly shown), and therefore the tilt of each line segment with respect to the width direction is almost visually incognizable. Sets of the line segments are arranged at a predetermined interval in the scan direction and in each of four colors, CMYK, dots are formed on the line segments in the width direction at a resolution of almost 720 dpi. Therefore, in the printer 1, color printing of the four colors, CMYK, can be achieved on the printing paper 9 in the width direction at a resolution of almost 720 dpi.

Figure 7:
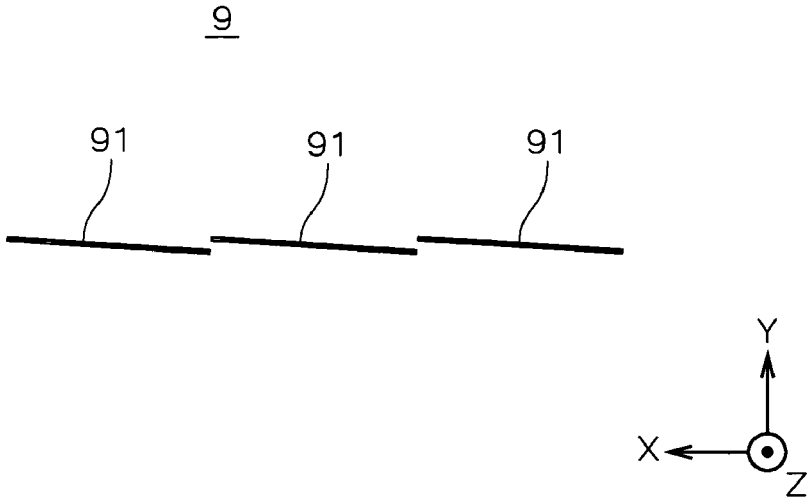
FIG. 7 is a view showing an arrangement of dots tilted in one direction.

If each of the outlet rows in each head are tilted toward a certain direction with respect to the width direction to perform the same writing, as shown in FIG. 7, the arrangement of dots of each line segment 91 is isolated and a break between the line segments 91 can be recognized. On the other hand, in the printer 1, since the rows of dots arranged in the first tilt direction and those of dots arranged in the second tilt direction are alternately connected to one another in the width direction as discussed above, an image printing can be achieved without any break between the line segments which causes a feeling that something is wrong.

Figure 8:
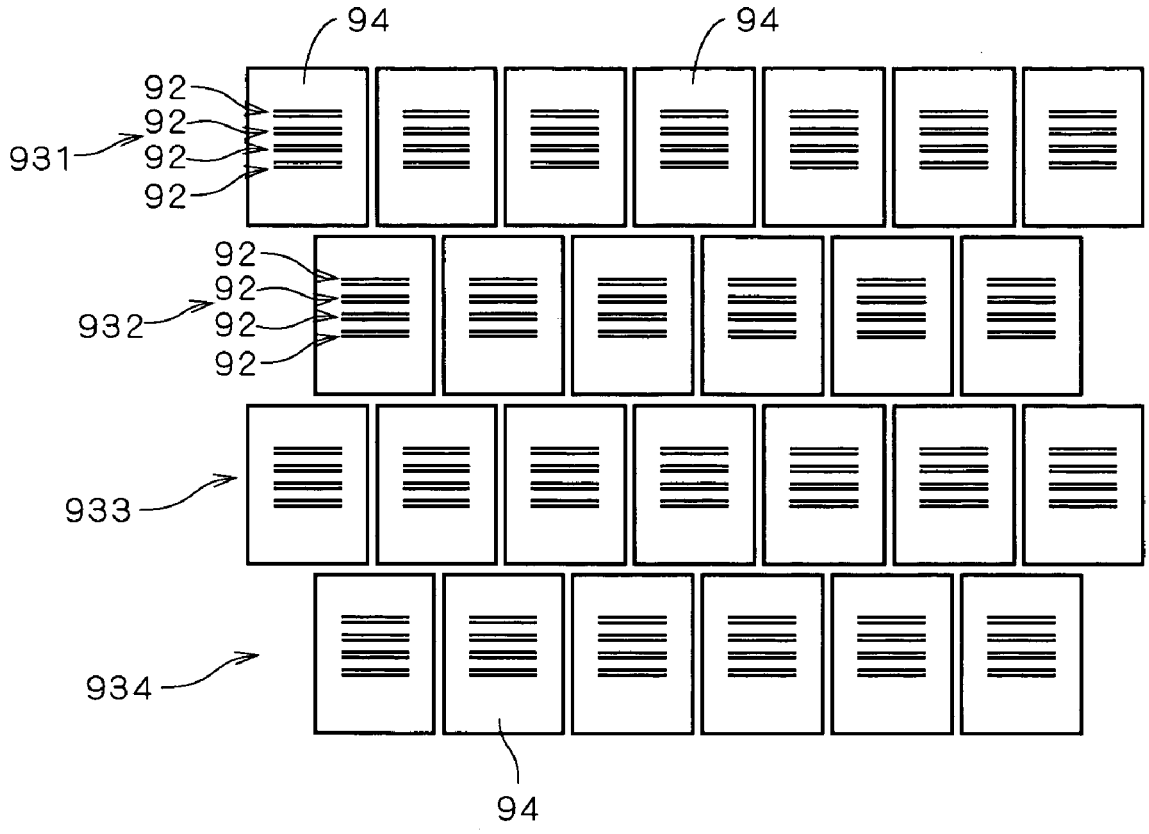
FIG. 8 is a view showing an arrangement of heads.

As shown in FIG. 8, if inks of the four colors CMYK are assigned to four outlet groups 92 in each head 94 and with respect to the outlet groups 92 for ejecting ink of one color, an antecedent head row 931 (or head row 932) and a following head row 933 (or head row 934) are provided so that a gap between the outlets of the outlet groups 92 in the antecedent head row 931 (932) should be interpolated by the outlet in the following head row 933 (934) in the width direction, a high-level position adjustment of the heads 94 arranged in the scan direction is needed. Further, since two corresponding outlet groups 92 are positioned largely away from each other in the scan direction, if the printing paper 9 is moved, being tilted with respect to the scan direction, or the like, there arises positional difference of dots to be formed by the outlet groups 92, to decrease precision in printing. On the other hand, in the printer 1 of FIG. 1, with the arrangement of the heads 5 being tilted, the two outlet groups 60 which interpolate each other in the width direction are provided in one head 5 for each of the four colors CMYK and the distance between the two outlet groups 60 in the scan direction can be limited to a certain range. It is thereby possible to fabricate the head unit 2 without the high-level position adjustment of the heads 5 arranged in the scan direction and suppress positional difference of dots to be formed, and therefore high-resolution color printing can be easily achieved by using the low-resolution heads 5.

In the printer 1, by disposing the outlets 7 in each outlet group 60 in two-row staggered arrangement, it is possible to increase a resolution. Since the outlet groups 60 for ejecting ink of on color and the outlet groups 60 for ejecting ink of another color are alternately arranged in each head 5, the distance between the outlet groups 60 which interpolate each other in the scan direction can be made relatively longer in one head 5 to decrease the tilt angle of the head.

Figure 9:
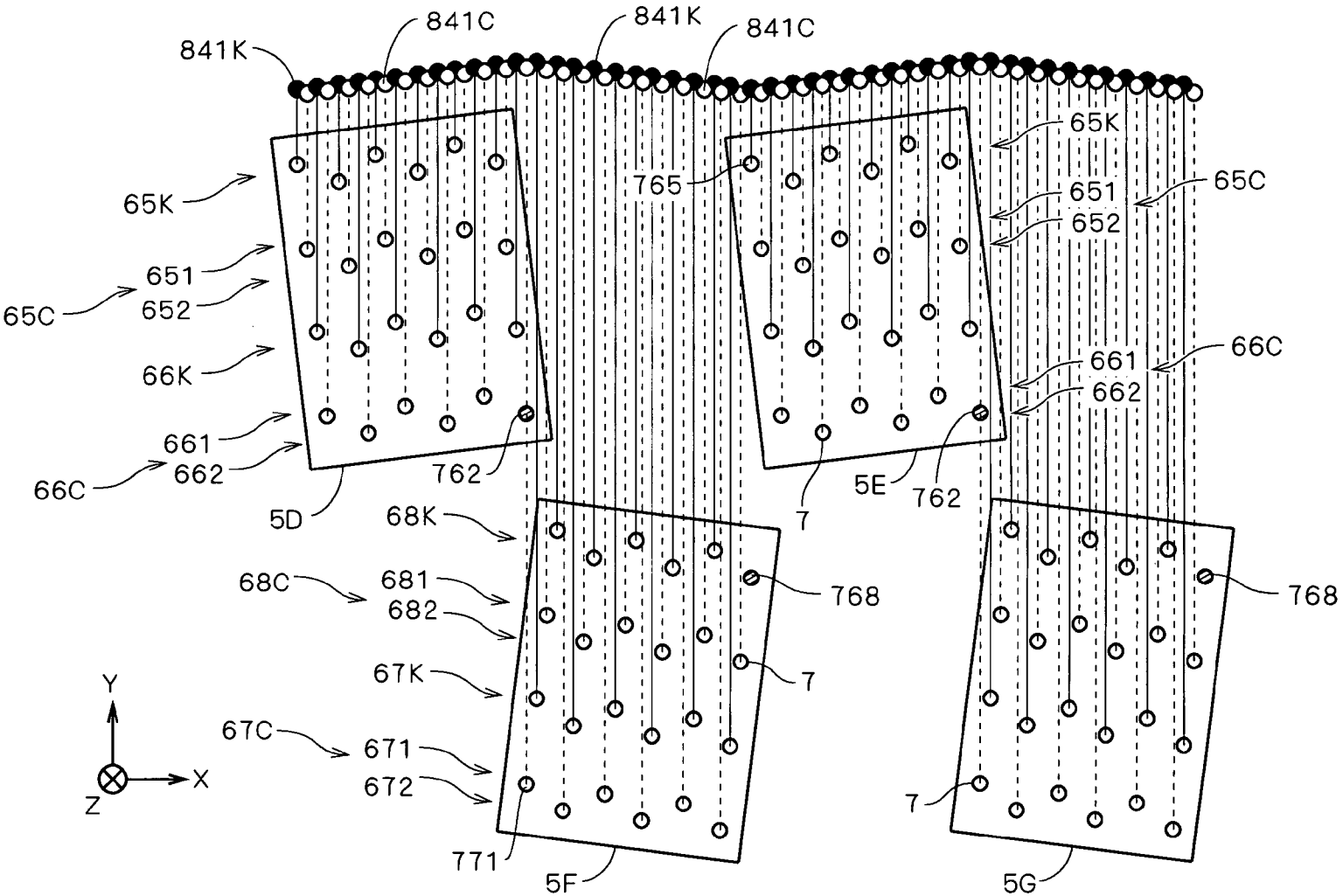
FIG. 9 is a view showing another exemplary arrangement of a plurality of heads.

Next, discussion will be made on another example of the printer 1. Another exemplary printer 1 is different from the printer 1 of FIG. 1 only in arrangement of a plurality of heads and colors of ink ejected from the outlet groups and basically has the same construction. FIG. 9 is a view showing outlet groups in a plurality of heads in another exemplary printer 1, and in FIG. 9, two heads 5D and 5E included in a head row which corresponds to the head row 51*a* of FIG. 2 and two heads 5F and 5G included in a head row which corresponds to the head row 52*a* are only shown and the heads 5D to 5G are provided with outlet groups for ejecting ink of C or K. In the printer 1 of another example, actually, two head rows which correspond to the head rows 51*b* and 52*b* of FIG. 2, respectively, (i.e., the two head rows for ejecting inks of M and Y) are further provided and a lot of heads are arranged in the width direction (X direction) in each head row. In FIG. 9, for convenience of illustration, six outlets 7 are disposed in two-row staggered arrangement in one outlet group and for easy understanding, dots to be formed on the printing paper 9 are also virtually shown above the outlets (assuming that inks are ejected from all the outlets 7). Though the following discussion will be made on a plurality of heads 5D to 5G, the same applies to other heads.

Out of a plurality of heads 5D to 5G, each of the two heads 5D and 5E on the (+Y) side has an outlet group 65K for ejecting ink of K, an outlet group 65C for ejecting ink of C, an outlet group 66K for ejecting ink of K and an outlet group 66C for ejecting ink of C in this order from the (+Y) side (toward the (−Y) side). Each of the two heads 5F and 5G on the (−Y) side has an outlet group 68K for ejecting ink of K, an outlet group 68C for ejecting ink of C, an outlet group 67K for ejecting ink of K and an outlet group 67C for ejecting ink of C in this order from the (+Y) side. Thus, in a plurality of heads 5D to 5G of FIG. 9, the outlet groups for ejecting ink of K and those for ejecting ink of C are alternately arranged in the scan direction (Y direction) and in the same order in each of heads 5D and 5E on the (+Y) side and heads 5F and 5G on the (−Y) side.

The arrangement of a plurality of outlets 7 in the outlet groups of each of the heads 5D to 5G is the same as that shown in FIGS. 3 and 4 and discussed earlier. Specifically, each outlet group has two outlet rows in which a plurality of outlets 7 are arranged, and in each of the outlet rows in the outlet groups of the two heads 5D and 5E on the (+Y) side, a plurality of outlets 7 are arranged at a regular pitch toward the first tilt direction tilted from the width direction by a predetermined minute angle θ in a plane parallel to the printing paper 9 and in each of the outlet rows in the outlet groups of the two heads 5F and 5G on the (−Y) side, a plurality of outlets 7 are arranged at the same pitch as that in the heads 5D and SE toward the second tilt direction tilted from the width direction to the opposite side of the first tilt direction by the minute angle θ in a plane parallel to the printing paper 9. The minute angle θ is determined so that two adjacent outlets 7 in the antecedent outlet group on the (+Y) side are interpolated by any one outlet 7 in the following outlet group on the (−Y) side in the width direction in each of the heads 5D to 5G.

Next, discussion will be made on arrangement of a plurality of heads 5D to 5G of FIG. 9. First, with respect to the heads 5D and 5F which are away from each other by a predetermined distance in the scan direction and adjacent to each other in the width direction, the heads 5D and 5F are arranged so that an outlet 762 on the (+X) side of an outlet row 662 on the (−Y) side of the outlet group 66C in the head 5D and an outlet 771 on the (−X) side of an outlet row 671 on the (+Y) side of the outlet group 67C in the head 5F should be disposed at the same position in the width direction. As discussed later, in printing something on the printing paper 9, since the outlets 762 which are hatched in FIG. 9 are not used, substantially, the outlets 7 in the outlet rows 662 and 671 are continuously arranged at a regular pitch in the width direction. The outlets 7 in each of other outlet rows of the head 5D are continuous with the outlets 7 in any of outlet rows of the head 5F at almost a regular pitch in the width direction. In the outlet groups 65C to 68C which eject ink of C in the heads 5D and 5F, for example, besides the above-discussed outlet rows 662 and 671, with respect to an outlet row 651 on the (+Y) side of the outlet group 65C in the head 5D and an outlet row 681 on the (+Y) side of the outlet group 68C in the head 5F, an outlet row 652 on the (−Y) side of the outlet group 65C and an outlet row 682 on the (−Y) side of the outlet group 68C, and an outlet row 661 on the (+Y) side of the outlet group 66C and an outlet row 672 on the (−Y) side of the outlet group 67C, the respective outlets 7 are continuous at almost a regular pitch in the width direction.

With respect to the heads 5F and 5E, the heads 5F and 5E are arranged so that an outlet 768 on the (+X) side of an outlet row on the (−Y) side of the outlet group 68K in the head 5F and an outlet 765 on the (−X) side of an outlet row on the (+Y) side of the outlet group 65K in the head 5E should be disposed at the same position in the width direction. In printing discussed later, since the outlets 768 which are hatched in FIG. 9 are not used, substantially, the outlets 7 in the outlet row including the outlet 768 and the outlet row including the outlet 765 are continuously arranged at a regular pitch in the width direction. At this time, in the heads 5F and 5E, like in the case of the heads 5D and 5F, in the outlet groups 65C to 68C for ejecting ink of C, for example, with respect to the outlet row 681 of the head 5F and the outlet row 661 of the head 5E, the outlet row 682 and the outlet row 662, the outlet row 671 and the outlet row 651, and the outlet row 672 and the outlet row 652, the respective outlets 7 are continuous at almost the regular pitch in the width direction.

Thus, in the printer 1 of another example, with respect to the two heads which are away from each other in the scan direction and adjacent to each other in the width direction, a plurality of heads 5D to 5G are arranged so that one outlet 7 in one head on the side of the other head and one outlet in the other head on the side of one head should be arranged at the same position in the width direction. Then, in the whole of the head unit, for one color, the outlets 7 are continuously arranged at a regular pitch corresponding to a predetermined resolution (about 720 dpi) in the width direction.

Considering the arrangement of the outlets 7 for ejecting ink of the same color with the outlet group as a unit, from the above correspondence of the outlet rows, it can be thought that if two heads which are away from each other in the scan direction and adjacent to each other in the width direction have the outlets 7 for the color disposed at the same position in the width direction (with respect to the outlet group for ejecting ink of C, for example, in the heads 5D and 5F of FIG. 9), the antecedent outlet groups for the color on the (+Y) side in these heads are in a correspondence with each other and so are the following outlet groups on the (−Y) side in these heads and if two adjacent heads do not have the outlets for the color disposed at the same position in the width direction (with respect to the outlet group for ejecting ink of C, for example, in the heads 5F and 5E of FIG. 9), for this color, the antecedent outlet group in one head and the following outlet group in the other head are in a correspondence with each other and so are the following outlet group in one head and the antecedent outlet group in the other head.

In the printer 1 having a plurality of heads 5D to 5G of FIG. 9, in each of the heads 5D and 5E included in the head row on the (+Y) side, dots are written for each color on a line segment directed toward the first tilt direction on the printing paper 9 by performing the ejection control for all the outlets at the same time in each outlet row, with the outlet 762 unused. At this time, in each head, the dots written by the antecedent outlet group for each color are interpolated by the dots written by the following outlet group for the color. Subsequently, in each of the heads 5F and 5G included in the head row on the (−Y) side, similarly, dots are written on a line segment which continuously extends from the above line segment toward the second tilt direction by performing the ejection control for all the outlets at the same time in each outlet row, with the outlet 768 unused. In a plurality of heads 5D to 5G of FIG. 9, as virtually shown in FIG. 9, dots 841K for color K and dots 841C for color C are thereby formed on the printing paper 9. As a result, without any complicate ejection control for each outlet 7, it is possible to perform color printing of CMYK at a resolution of almost 720 dpi.

Figure 10:
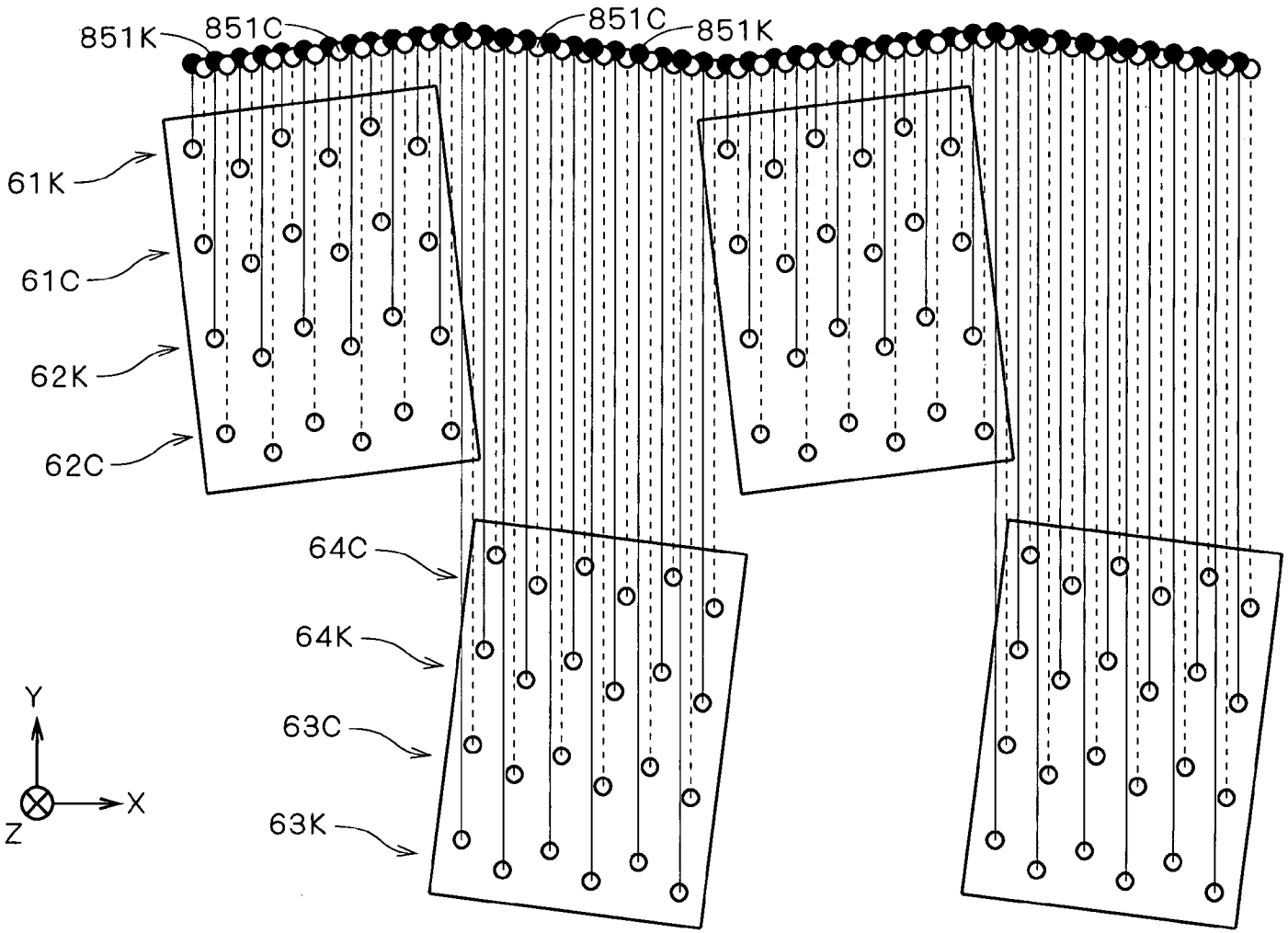
FIG. 10 is a view showing outlet groups in a plurality of heads.

On the other hand, in the case of head arrangement in the head unit 2 of FIG. 2, as shown in FIG. 10, in the head included in the head row on the (+Y) side, the outlet group 61K for ejecting ink of K, the outlet group 61C for ejecting ink of C, the outlet group 62K for ejecting ink of K and the outlet group 62C for ejecting ink of C are arranged in this order from the (+Y) side (toward the (−Y) side), and in the head included in the head row on the (−Y) side, the outlet group 64C for ejecting ink of C, the outlet group 64K for ejecting ink of K, the outlet group 63C for ejecting ink of C and the outlet group 63K for ejecting ink of K are arranged in this order from the (+Y) side. In this case, in the head on the (+Y) side and the head on the (−Y) side, the outlet groups for ejecting ink of K and the outlet groups for ejecting ink of C are arranged in the different order in the scan direction (Y direction) and as virtually shown in FIG. 10, the overlapping order of the dots 851K for color K and the dots 851C for color C to be formed on the printing paper 9 (in other words, the order of writing the dots for color K and the dots for color C almost at the same position on the printing paper 9) is different between the head on the (+Y) side and the head on the (−Y) side.

Figure 11:
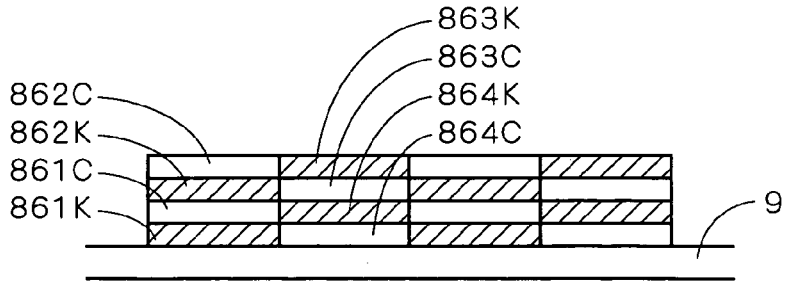
FIGS. 11 and 12 are abstract views showing an overlapping condition of dots.

FIG. 11 is an abstract view showing an overlapping condition of dots. In FIG. 11, sets of dots which are written by the outlet groups 61K to 64K and 61C to 64C in the heads and arranged almost in the X direction are indicated by rectangles 861K to 864K and 861C to 864C, respectively. As shown in FIG. 11, in printing by a plurality of heads of FIG. 10, the overlapping order of the sets of dots for color K and the sets of dots for color C which are formed on the printing paper 9 by a plurality of outlet groups in the heads on the (+Y) side and the overlapping order of the sets of dots for color K and the sets of dots for color C which are formed by a plurality of outlet groups in the heads on the (−Y) side are different from each other, and there arises a slight difference in mixed color represented by overlapping the dots of some colors on the printing paper 9 between the head on the (+Y) side and the head on the (−Y) side, to sometimes cause density irregularity depending on the type of image to be printed, the resolution of an image after printing or the like.

Figure 12:
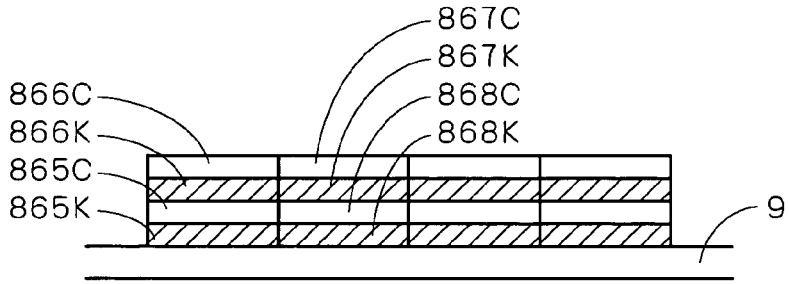

On the other hand, in the printer 1 having a plurality of heads 5D to 5G of FIG. 9, in each of the heads 5D and 5E on the (+Y) side and the heads 5F and 5G on the (−Y) side, the outlet groups for ejecting ink of K and the outlet groups for ejecting ink of C are arranged in the same order in the scan direction. Therefore, as shown in FIG. 12 as a comparison with FIG. 11, in printing by the printer 1 of another example, the overlapping order of the sets of dots for color K and the sets of dots for color C to be formed on the printing paper 9 by a plurality of outlet groups in the heads on the (+Y) side (in FIG. 12, the sets of dots which are written by the outlet groups 65K to 68K and 65C to 68C in the heads and arranged almost in the X direction are indicated by rectangles 865K to 868K and 865C to 868C, respectively) and the overlapping order of the sets of dots for color K and the sets of dots for color C to be formed by a plurality of outlet groups in the heads on the (−Y) side are the same. As a result, in the printer 1 having a plurality of heads of FIG. 9, it is possible to prevent variation in mixed color on the printing paper 9 after printing, which is caused by the order of the outlet groups for ejecting ink of one color and the outlet groups for ejecting ink of another color in a plurality of heads in the scan direction, and achieve high-quality color printing. In order to efficiently perform color printing of certain quality by using all the outlets, however, it is preferable to use the printer 1 of FIG. 1.

Figure 13:
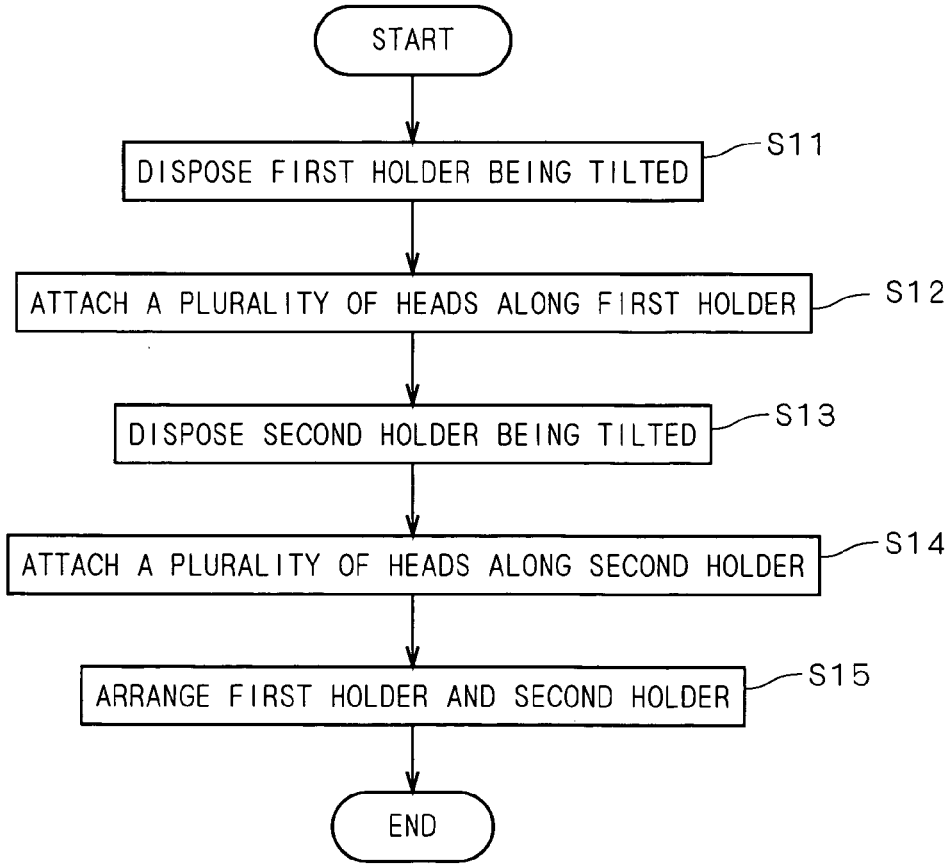
FIG. 13 is a flowchart showing an operation flow for fabricating the head unit.

Next, discussion will be made on a method of fabricating the head unit 2 in the printer 1. FIG. 13 is a flowchart showing an operation flow for fabricating the head unit 2.

Figure 14:
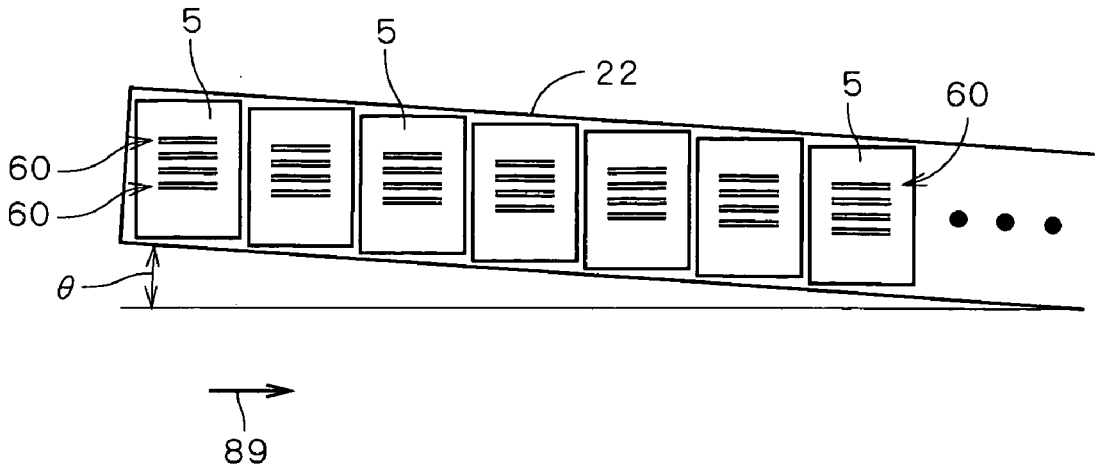
FIG. 14 is a view showing a state of disposing a holder to be tilted.

In fabricating the head unit 2, first, a long-length holder 22 before the head 5 is attached thereto (hereinafter, referred to as "the first holder") is disposed, being tilted from a predetermined horizontal direction (a reference direction in the operation, which is indicated by the arrow 89 in FIG. 14) to the opposite side of the first tilt direction by the minute angle θ as shown in FIG. 14 (Step S11). At this time, since the first holder 22 is long, it is possible to easily tilt the first holder 22 by only the minute angle θ.

When the first holder 22 is disposed, being tilted, an operator moves each of a plurality of heads along the horizontal direction and a direction orthogonal to the horizontal direction with its posture kept along these two directions by using a microscope and a measuring machine and sequentially fixes them onto the first holder 22. In other words, a plurality of heads 5 are fixed along the first holder 22 with the arrangement direction of the outlet groups 60 adjusted to the horizontal direction (Step S12). It is thereby possible to easily achieve fixing of the plurality of heads 5 along the holder 22, with the arrangement direction of the outlet groups 60 relatively tilted from the longitudinal direction of the first holder 22 by only the minute angle θ.

Subsequently, another holder (hereinafter, referred to as "the second holder") 22 is prepared and disposed, being tilted from the horizontal direction to the opposite side of the first holder 22 by the same angle θ (Step S13). A plurality of heads 5 are fixed along the second holder 22 with the arrangement direction of the outlet groups 60 adjusted to the horizontal direction (Step S14). It is thereby possible to easily achieve fixing of the plurality of heads 5 along the holder 22, with the arrangement direction of the outlet groups 60 relatively tilted from the longitudinal direction of the long-length second holder 22 to the opposite side of the case of the first holder 22 by the same angle θ.

Figure 15:
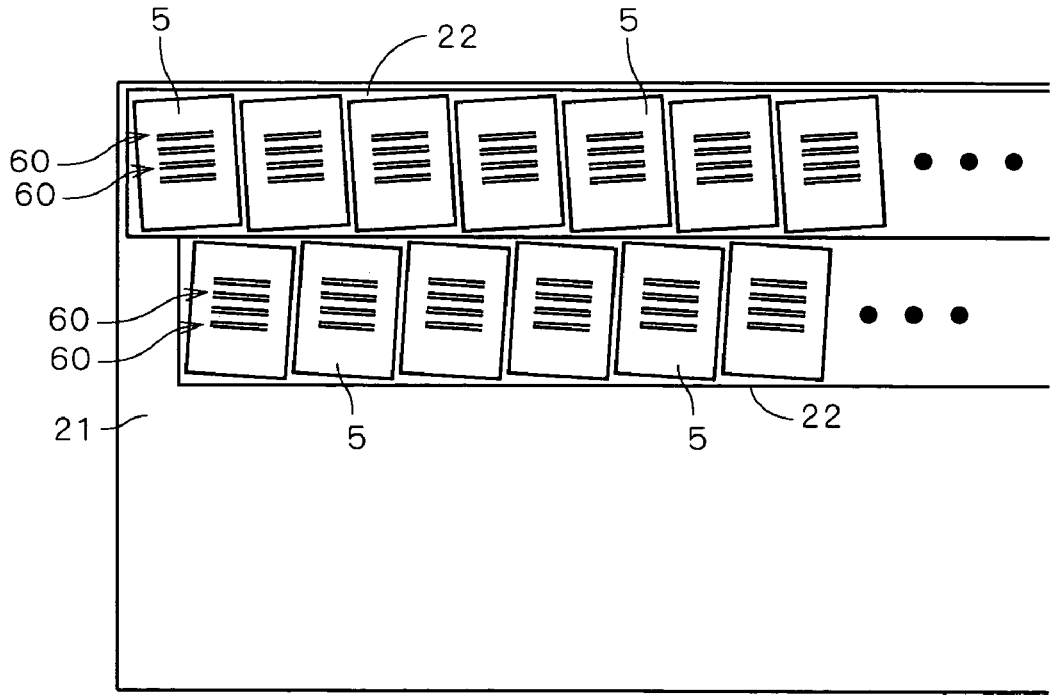
FIG. 15 is a view showing a state of arranging a first holder and a second holder.

After the first holder 22 and the second holder 22 are prepared, as shown in FIG. 15, on the head unit body 21, the first holder 22 (the upper holder 22 in FIG. 15) and the second holder 22 (the lower holder 22 in FIG. 15) are arranged in a direction orthogonal to the longitudinal direction, with their longitudinal directions made uniform (Step S15). All the heads 5 in each holder 22 are thereby collectively arranged, being tilted. At this time, with respect to the corresponding outlet groups 60 in the plurality of heads 5 on the first holder 22 and the plurality of heads 5 on the second holder 22 (for example, the top outlet groups 60 in the heads 5 on the first holder 22 and the bottom outlet groups 60 in the heads 5 on the second holder 22) in FIG. 15, respective positions of the first and second holders 22 are relatively adjusted in the longitudinal direction so that the plurality of outlet groups 60 on the first holder 22 and the plurality of outlet groups 60 on the second holder 22 should be alternately continuous group by group in the longitudinal direction. Though a head unit may be provided with only one pair of the first and second holders 22, in the case of the head unit 2 of FIG. 2, two pairs of the first and second holders 22 are prepared and alternately arranged in a direction orthogonal to the longitudinal direction.

Thus, in fabrication of the head unit of FIG. 13, the plurality of heads 5 are arranged on the holder 22, being tilted, and the plurality of holders 22 to which the heads 5 are attached are arranged on the head unit body 21 in a direction orthogonal to the longitudinal direction, to fabricate the head unit 2. If a plurality of heads are individually disposed, being tilted, on the head unit body 21, a complicate operation is needed to adjust the position and posture, but since the heads 5 are arranged on the head unit body 21 with the holder 22 as a unit in the above method, it is possible to easily fabricate the head unit 2. Further, since positioning is performed with each of the plurality of heads 5 moved in the horizontal direction and a direction orthogonal to the horizontal direction with respect to the holder 22 tilted from the horizontal direction, it is possible to easily attach the plurality of heads 5 to the holder 22 with the arrangement direction of the outlet groups 60 tilted from the longitudinal direction of the holder 22 by only the minute angle θ. The head unit having the plurality of heads shown in FIG. 9 can be fabricated by the same operation.

Figure 16:
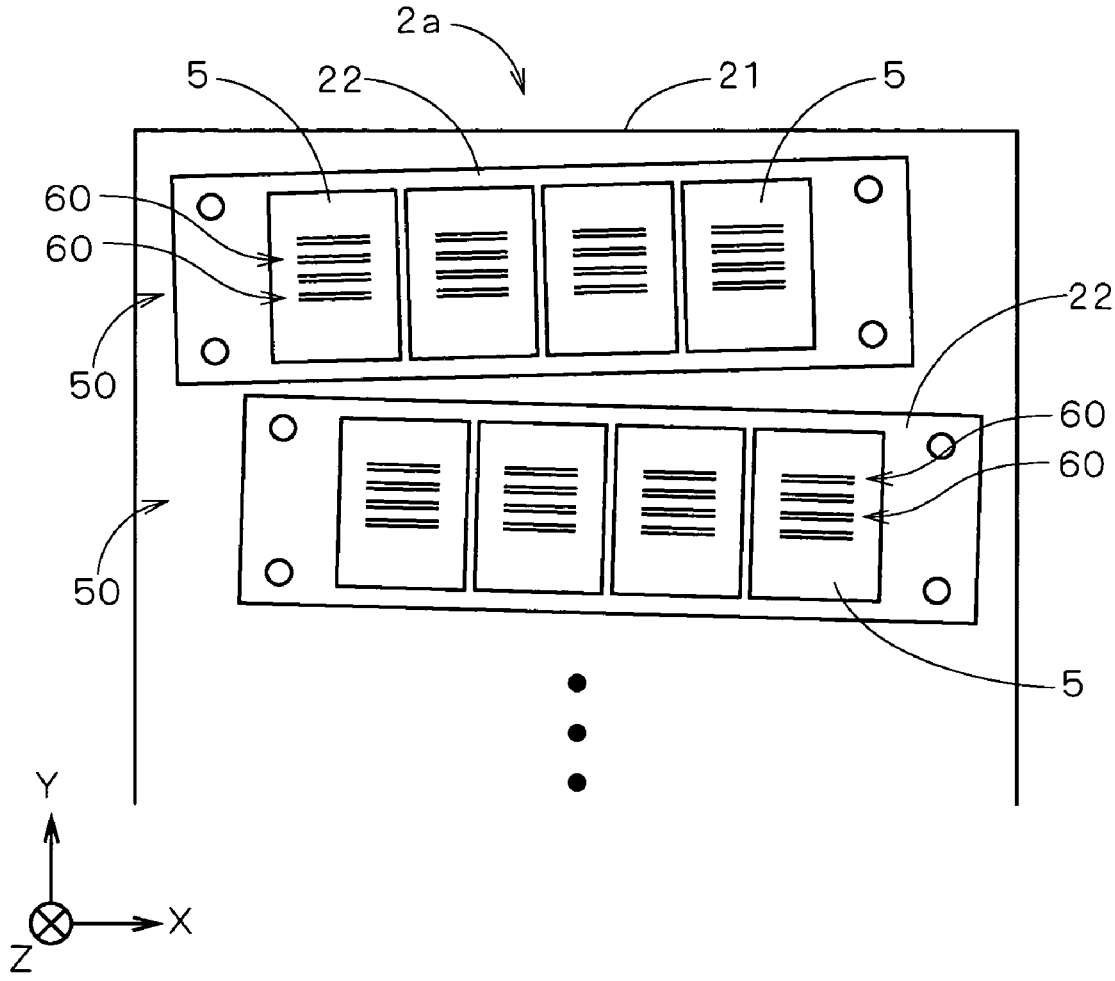
FIG. 16 is a view showing another example of head unit.

Next, discussion will be made on still another example of printer 1. FIG. 16 is a bottom plan view showing a construction of a head unit 2*a* in the still another example of printer 1. The head unit 2*a* of FIG. 16 has eight holders 22 (only two holders 22 are shown in FIG. 16), and the eight holders 22 are arranged in the scan direction and fixed on the head unit body 21, being tilted alternately in the first tilt direction and the second tilt direction. A plurality of heads 5 (four heads 5 in FIG. 16) are arranged and attached onto each of the holders 22 along the longitudinal direction of the holder 22, to form one head row 50. Each of the heads 5 has four outlet groups 60 like in the head unit 2 of FIG. 2 and each of the outlet groups 60 is also tilted in the first tilt direction or the second tilt direction in accordance with the tilt direction of the holder 22. In the printer 1 of FIG. 16, the colors CMYK are assigned to every two head rows from the (+Y) side and all the outlet groups 60 in the heads 5 included in this two head rows eject ink of the same color. Though the following discussion will be made with respect to a combination of head rows for ejecting ink of one of the four colors CMYK, other combinations of head rows for ejecting ink of other colors have the same construction and arrangement.

Figure 17:
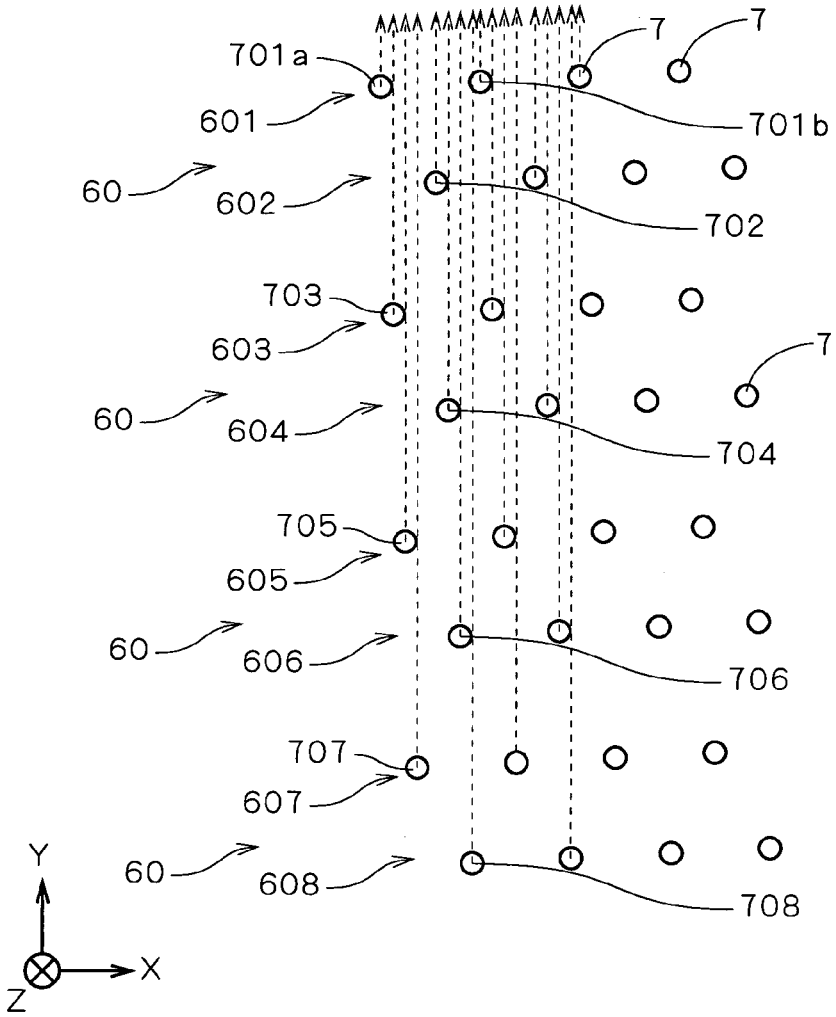
FIG. 17 is a view showing outlet groups in one head.

FIG. 17 is a view showing four outlet groups 60 in one head 5. As shown in FIG. 17, each of the outlet groups 60 has a plurality of outlets 7 which are disposed in two-row staggered arrangement like the outlet groups of FIG. 3, and in the entire head 5, eight outlet rows 601 to 608 are arranged in the scan direction. In each of the outlet rows 601 to 608, a plurality of outlets 7 are arranged at a regular pitch toward the first tilt direction in a plane parallel to the printing paper 9.

In the outlet groups 60 o FIG. 17, with respect to the width direction, for example, the first tilt direction in the head unit 2*a* is determined so that between one outlet 701*a* in the outlet row 601 of the antecedent outlet group 60 on the (+Y) side and an outlet 702 in the outlet row 602, which is adjacent to the outlet 701*a* in the width direction, one outlet 703 in the outlet row 603, one outlet 705 in the outlet row 605 and one outlet 707 in the outlet row 607 should be positioned in this order from the (−X) side (toward the (+X) side), and between the outlet 702 and an outlet 701*b* in the outlet row 601, which is adjacent to the outlet 702 on the opposite side of the outlet 701*a* in the width direction, one outlet 704 in the outlet row 604, one outlet 706 in the outlet row 606 and one outlet 708 in the outlet row 608 should be positioned in this order from the (−X) side. In other words, the minute angle θ of the first tilt direction with respect to the width direction is determined so that two adjacent outlets 7 in the antecedent outlet group 60 in the width direction should be interpolated by the outlet 7 included in each of a plurality of following outlet groups 60. With this setting, a plurality of outlets 7 of the four outlet groups 60 in the head 5 of FIG. 17 are densely continuous in the width direction.

Therefore, if the heads 5 having the above outlet rows in each of which the outlets are arranged at a pitch corresponding to 180 dpi, a plurality of outlets 7 in the four outlet groups 60 in each head 5 are arranged continuously in the width direction at a pitch corresponding to a resolution of almost 1440 dpi (exactly, slightly higher than 1440 dpi). Also in each head 5 included in the head rows 50 tilted in the second tilt direction (the head row 50 on the (−Y) side in FIG. 16), a plurality of outlets 7 are continuously arranged at the same pitch.

In the head unit 2*a* of FIG. 16, the correspondence of the outlet rows between the head row 50 on the (+Y) side and the head row 50 on the (−Y) side is the same as that in FIG. 4, and the outlets 7 in each of a plurality of outlet rows of the heads 5 included in the head row 50 on the (+Y) side and the outlets 7 in any one of a plurality of outlet rows of the heads 5 included in the head row 50 on the (−Y) side are continuously arranged at a regular pitch in the width direction. Therefore, in the whole of the head unit 2*a*, for one color, the outlets 7 are continuously arranged in the width direction at a pitch corresponding to a resolution of almost 1440 dpi.

In the printer 1 having the head unit 2*a* of FIG. 16, in each of a plurality of heads 5 included in the head row 50 on the (+Y) side, the ejection control is performed for all the outlets at the same time in each of the outlet rows to perform writing on a line segment directed toward the first tilt direction on the printing paper 9 and subsequently, in each of a plurality of heads 5 included in the head row 50 on the (−Y) side, the ejection control is performed for all the outlets at the same time in each of the outlet rows to perform writing on a line segment which extends continuously from the above line segment toward the second tilt direction. At this time, among the plurality of heads 5 included in each head row 50, the ejection timing is controlled so that dots to be written on the printing paper 9 by the outlets 7 of corresponding outlet rows should be formed at the same position in the scan direction. It is thereby possible to appropriately perform color printing at a resolution of almost 1440 dpi without a complicate ejection control for each of the outlets 7 in the printer 1 having the head unit 2*a* of FIG. 16.

Figure 18:
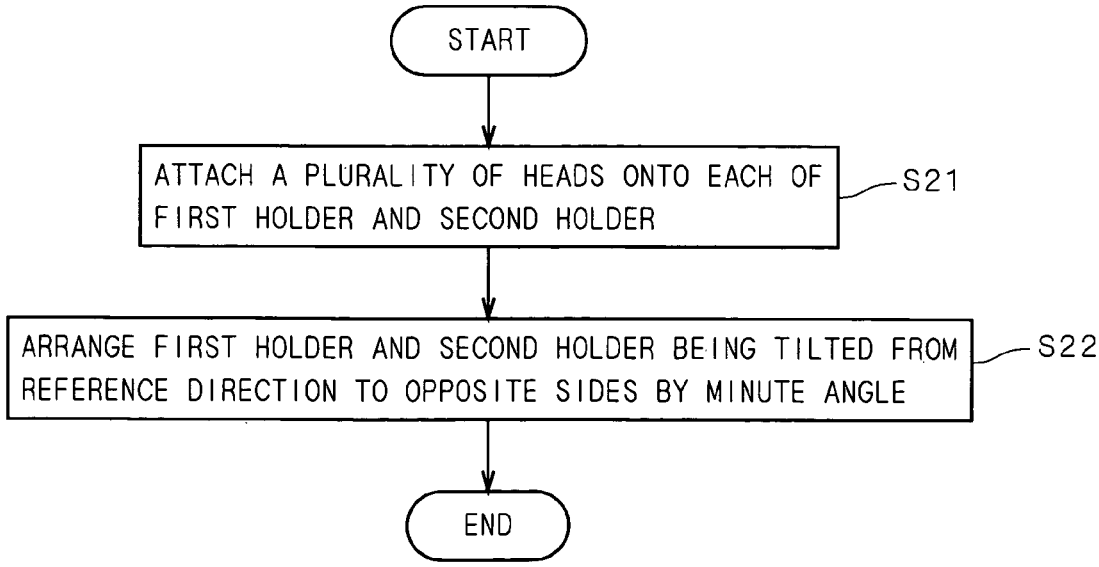
FIG. 18 is a flowchart showing an operation flow for fabricating the head unit.

Next, discussion will be made on a method of fabricating the head unit 2*a*. FIG. 18 is a flowchart showing an operation flow for fabricating the head unit 2*a*.

Figure 19:
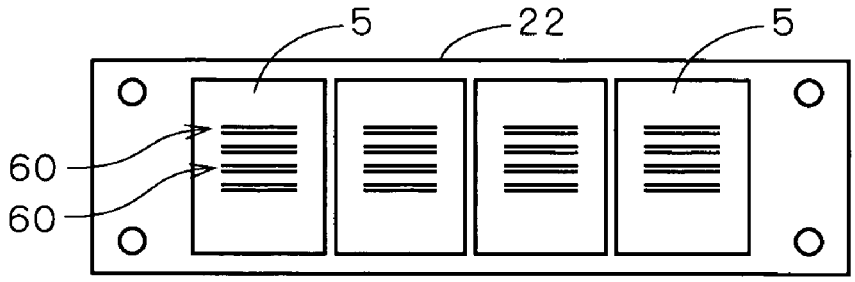
FIG. 19 is a view showing a state of attaching a plurality of heads to a holder.

In fabricating the head unit 2*a*, first, the long-length first holder 22 and second holder 22 before the heads 5 are attached thereto are prepared, and a plurality of heads 5 are attached to the first holder 22 and the second holder 22 as shown in FIG. 19 (in FIG. 19, however, only one holder 22 is shown) (Step S21). At this time, the arrangement direction of the outlet groups 60 in each head 5 is determined to be parallel to the longitudinal direction of the holder 22.

Subsequently, on the head unit body 21, the first holder 22 (the holder 22 on the (+Y) side of FIG. 16) is disposed, being tilted counterclockwise by the minute angle θ with respect to a predetermined reference direction (a direction parallel to the width direction on installation of the head unit 2*a* in the printer 1) and the second holder 22 (the holder 22 on the (−Y) side of FIG. 16) is disposed in a direction orthogonal to the reference direction from the first holder 22, being tilted clockwise by the same minute angle θ with respect to the reference direction. In other words, on the head unit body 21, the first holder 22 and the second holder 22 are arranged in the direction orthogonal to the reference direction, being tilted from the reference direction to the opposite sides by only the minute angle (Step S22). At this time, with respect to only the corresponding outlet groups 60 in a plurality of heads 5 on the first holder 22 and a plurality of heads 5 on the second holder 22, respective positions of the first holder 22 and the second holder 22 are adjusted relatively to the reference direction so that a plurality of outlet groups 60 on the first holder 22 and a plurality of outlet groups 60 on the second holder 22 should be alternately continuous group by group in the reference direction. On the head unit body 21, actually, four pairs of the first holders 22 and the second holders 22 are arranged in the direction orthogonal to the reference direction, to complete the head unit 2*a*.

Thus, in the head unit fabrication of FIG. 18, since a plurality of heads 5 are attached to the holder 22 with the arrangement direction of the outlet groups 60 made parallel to the longitudinal direction of the holder 22, it is possible to easily prepare the holder 22 provided with the plurality of heads 5. Then, since the long-length holders 22 are attached to the head unit body 21, being tilted with respect to the reference direction by only the minute angle, it is possible to easily fabricate the head unit 2*a*.

Though the preferred embodiment of the present invention has been discussed above, the present invention is not limited to the above-discussed preferred embodiment, but allows various variations.

Figure 20:
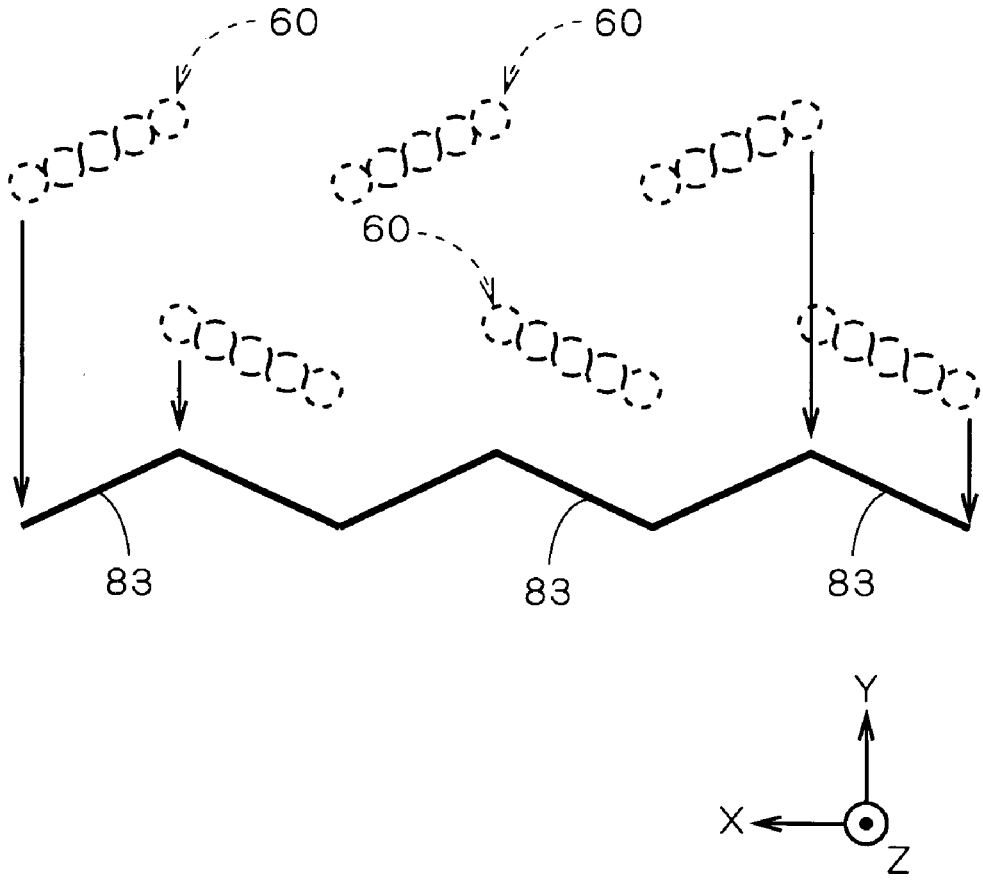
FIG. 20 is a view showing another example of outlet groups.

As indicated by broken lines in the upside of FIG. 20, for example, there may be a case where the outlet group 60 having only one outlet row along the first tilt direction or the second tilt direction is provided in each head, to form dots on each line segment 83 tilted along the first tilt direction or the second tilt direction as shown in the downside of FIG. 20. In the printer 1, only if at least one outlet row is provided in each head, the number of rows may be changed as appropriate in accordance with the resolution of an image to be written.

The angle θ of the first tilt direction or the second tilt direction with respect to the width direction may be changed in fabrication within tolerance of precision in printing. Since it is necessary to dispose the outlet in the outlet group 62K between the outlets in the outlet group 61K in the width direction in the case of the head 5 of FIG. 2 (also in the head of FIG. 9), or since it is necessary to dispose the respective outlets of a plurality of following outlet groups between the outlets in the antecedent outlet group in the width direction in the case of the head of FIG. 16, the adjustment range of the angle θ is very small, but since the printing range (for resolution) intrinsic to a printer needs only very small adjustment, the adjustment of printing range by using the angle θ in attachment of the head 5 works effectively. In a case where one outlet group 60 (or one outlet row) is provided in one head 5 as shown in FIG. 20, the adjustment range of the angle θ becomes much larger.

Thus, in the head unit 2 or 2*a* of the printer 1, it is an essential feature that one head 5 having the outlet group and another head 5 having another outlet group which is away from the above outlet group in the scan direction and adjacent to the above outlet group in the width direction are provided, one outlet group has at least one outlet row in which the outlets 7 are arranged along the first tilt direction and the other outlet group has at least one outlet row in which the outlets 7 are arranged along the second tilt direction and the outlets 7 of corresponding outlet rows between these heads 5 are arranged continuously at a regular pitch in the width direction. Then, the ejection control is performed for all the outlets at the same time in each outlet row of one outlet group to form a plurality of dots to be aligned in the first tilt direction on the printing paper 9 and after the head unit 2 is further moved relatively to the printing paper 9 by a predetermined distance from the position of the ejection control, the ejection control is performed for all the outlets at the same time in each outlet row of the other outlet group to form a plurality of dots to be aligned in the second tilt direction continuously with the dots aligned in the first tilt direction on the printing paper 9, and in the printer 1, it is thereby possible to perform printing at a finely-adjusted resolution without a complicate ejection control for controlling ejection of ink for each outlet 7.

In the printer 1 having the arrangement of heads shown in FIG. 9, in two heads which are away from each other in the Y direction and adjacent to each other in the X direction, one outlet 7 on the (+X) side of the head on the (−X) side and one outlet 7 on the (−X) side of the head on the (+X) side are disposed at the same position in the X direction and either one of the outlets 7 is unused in printing, but there may be a case where a plurality of outlets 7 on the (+X) side of the head on the (−X) side and the same number of outlets 7 on the (−X) side of the head on the (+X) side are disposed at the same positions respectively in the X direction and the outlets 7 in either one of the heads are unused in printing. In other words, in the printer, there may be case where in two heads which are away from each other in the scan direction and adjacent to each other in the width direction, at least one outlet of one head, which is positioned on the side of the other head in the width direction, and at least one outlet of the other head, which is positioned on the side of one head in the width direction, are disposed at almost the same position and the outlet in one or the other head is unused, and in these two heads, the outlets of corresponding outlet rows are thereby continuously arranged substantially in the width direction at almost a regular pitch (this pitch is not needed to be exactly regular but may be such a pitch as to be thought as regular one within a range where no feeling of something wrong is caused in an image to be written). To prevent variation in mixed color on the printing paper 9 after printing, which is caused by the order of the outlet group for ejecting ink of one color and the outlet group for ejecting ink of another color in a plurality of heads in the scan direction and perform efficient color printing, however, it is preferable to make only one outlet unused. Naturally, by manufacturing a special head with no outlet formed at the position where an unused outlet(s) needs to be disposed and so on, the outlet group(s) for ejecting ink of one color and the outlet group(s) for ejecting ink of another color in a plurality of heads may be arranged in the same order in the scan direction without providing any outlet which is made unused in printing.

Though printing is performed on the entire printing paper 9 by passing the printing paper 9 under the head unit 2 or 2*a* once (one-pass printing) in the above preferred embodiment, the printer 1 may be provided with a mechanism for moving the head unit relatively to the printing paper 9 in the width direction. Alternatively, the printer 1 may be provided with a mechanism for moving the head unit relatively to the printing paper 9 in the scan direction, and the head unit only has to be moved relatively to the printing paper 9 in the scan direction.

An object on which printing is performed is not limited to the printing paper 9 but may be other printing media such as film or disk.

While the invention has been shown and described in detail, the foregoing description is in all aspects illustrative and not restrictive. It is therefore understood that numerous modifications and variations can be devised without departing from the scope of the invention.

This application claims priority benefit under 35 U.S.C. Section 119 of Japanese Patent Application No. 2004-298880 and Japanese Patent Application No. 2005-236720 filed in the Japan Patent Office on Oct. 13, 2004 and Aug. 17, 2005, the entire disclosure of which is incorporated herein by reference.

What is claimed is:

1. An inkjet printer comprising:

a head unit for ejecting droplets of ink onto printing media;

a moving mechanism for moving said head unit relatively to said printing media toward a predetermined scan direction along said printing media; and an ejection control part for controlling ejection of ink from said head unit, wherein said head unit comprises a first ejection module including a first outlet group; and a second ejection module including a second outlet group disposed at a predetermined distance away from said first outlet group in said scan direction, adjacently to said first outlet group in a width direction orthogonal to said scan direction, said first outlet group includes at least one first outlet row in which outlets are arranged in a first tilt direction which tilts from said width direction by a minute angle in a plane parallel to said printing media, said second outlet group includes at least one second outlet row in which outlets are arranged in a second tilt direction which tilts from said width direction to an opposite side of said first tilt direction by said minute angle in a plane parallel to said printing media;

outlets in each of said at least one first outlet row and outlets in any of said at least one second outlet row are continuously disposed at a regular pitch in said width direction, and with a control by said ejection control part, a writing is performed on a first line segment which is directed toward said first tilt direction on said printing media through a first ejection control performed simultaneously for all outlets in each first outlet row and after said head unit is moved relatively to said printing media by said predetermined distance from a position of said first ejection control, a writing is performed on a second line segment which extends in said second tilt direction continuously from said first line segment through a second ejection control performed simultaneously for all outlets in each second outlet row.

2. The printer according to claim 1, wherein outlets are disposed in a staggered arrangement in two rows in each of said first outlet group and said second outlet group.

3. The printer according to claim 1, wherein said first ejection module includes another first outlet group disposed away from said first outlet group in said scan direction in the same manner as said first outlet group, which interpolates dots written by said first outlet group in said width direction, and said second ejection module includes another second outlet group disposed away from said second outlet group in said scan direction in the same manner as said second outlet group, which interpolates dots written by said second outlet group in said width direction.

4. The printer according to claim 3, wherein said another first outlet group and said another second outlet group are positioned between said first outlet group and said second outlet group in said scan direction.

5. The printer according to claim 3, wherein said first outlet group and said another first outlet group eject ink of one color and said first ejection module further includes a first outlet group and another first outlet group for ejecting ink of another color, which are disposed in the same manner as said first outlet group and said another first outlet group for ejecting ink of said one color, and said second outlet group and said another second outlet group eject ink of said one color and said second ejection module further includes a second outlet group and another second outlet group for ejecting ink of said another color, which are disposed in the same manner as said second outlet group and said another second outlet group for ejecting ink of said one color.

6. The printer according to claim 5, wherein outlet groups for ejecting ink of said one color and outlet groups for ejecting ink of said another color are arranged alternately in each of ejection modules.

7. The printer according to claim 1, wherein said first outlet group ejects ink of one color and said first ejection module includes a first outlet group for ejecting ink of another color, which is disposed in the same manner as said first outlet group for ejecting ink of said one color, said second outlet group ejects ink of said one color and said second ejection module includes a second outlet group for ejecting ink of said another color, which is disposed in the same manner as said second outlet group for ejecting ink of said one color, and outlet group for ejecting ink of said one color and outlet group for ejecting ink of said another color are arranged in the same order in said scan direction in each of said first ejection module and said second ejection module.

8. The printer according to claim 7, wherein said first ejection module includes another first outlet group for ejecting ink of said one color disposed away from said first outlet group which ejects ink of said one color in said scan direction in the same manner as said first outlet group for ink of said one color, which interpolates dots written by said first outlet group for ink of said one color in said width direction; and another first outlet group for ejecting ink of said another color disposed away from said first outlet group which ejects ink of said another color in said scan direction in the same manner as said first outlet group for ink of said another color, which interpolates dots written by said first outlet group for ink of said another color in said width direction, and said second ejection module includes another second outlet group for ejecting ink of said one color disposed away from said second outlet group which ejects ink of said one color in said scan direction in the same manner as said second outlet group for ink of said one color, which interpolates dots written by said second outlet group for ink of said one color in said width direction; and another second outlet group for ejecting ink of said another color disposed away from said second outlet group which ejects ink of said another color in said scan direction in the same manner as said second outlet group for ink of said another color, which interpolates dots written by said second outlet group for ink of said another color in said width direction.

9. The printer according to claim 8, wherein outlet groups for ejecting ink of said one color and outlet groups for ejecting ink of said another color are arranged alternately in each of ejection modules.

10. The printer according to claim 7, wherein at least one outlet in said first ejection module on the side of said second ejection module and at least one outlet in said second ejection module on the side of said first ejection module are disposed at the same position in said width direction, and by making said at least one outlet in said first ejection module or said second ejection module unused, outlets in corresponding outlet rows are continuously present substantially at a regular pitch in said width direction in said first ejection module and said second ejection module.

11. The printer according to claim 10, wherein said at least one outlet is one outlet.

12. A head unit fabricating method for fabricating a head unit which ejects droplets of ink in an inkjet manner, comprising the steps of:

a) attaching a plurality of first ejection modules each comprising a first outlet group disposed in a predetermined arrangement direction along a long-length first holder with said arrangement direction tilted from a longitudinal direction of said first holder by a minute angle;

b) attaching a plurality of second ejection modules each comprising a second outlet group disposed in a predetermined arrangement direction along a long-length second holder with said arrangement direction tilted from a longitudinal direction of said second holder to the opposite side of the case of said first holder by said minute angle; and c) arranging said first holder and said second holder in a direction orthogonal to longitudinal directions thereof, with said longitudinal directions thereof made uniform, and continuously arranging a plurality of first outlet groups and a plurality of second outlet groups alternately group by group in said longitudinal directions.

13. The head unit fabricating method according to claim 12, wherein said step a) comprises the steps of disposing said first holder to be tilted from a predetermined horizontal direction by said minute angle; and attaching said plurality of first ejection modules along said first holder with said arrangement direction of said first outlet groups adjusted to said horizontal direction, and said step b) comprises the steps of disposing said second holder to be tilted from said horizontal direction to the opposite side of said first holder by said minute angle; and attaching said plurality of second ejection modules along said second holder with said arrangement direction of said second outlet groups adjusted to said horizontal direction.

14. A head unit fabricating method for fabricating a head unit which ejects droplets of ink in an inkjet manner, comprising the steps of:

attaching a plurality of ejection modules each comprising an outlet group disposed in a predetermined arrangement direction onto a first holder and a second holder, with said arrangement direction made parallel to a longitudinal direction of long-length holders; and arranging said first holder and said second holder in a direction orthogonal to a predetermined reference direction, to be tilted from said reference direction to opposite sides by a minute angle, and continuously arranging a plurality of first outlet groups in ejection modules attached on said first holder and a plurality of second outlet groups in ejection modules attached on said second holder alternately group by group in said reference direction.

* * * * *